US007445539B2

(12) United States Patent
Laurienzo et al.

(10) Patent No.: US 7,445,539 B2
(45) Date of Patent: Nov. 4, 2008

(54) TOY VEHICLE WITH A DETACHABLY ATTACHABLE WHEEL

(75) Inventors: Dominic Laurienzo, Los Angeles, CA (US); Brendon Vetuskey, Van Nuys, CA (US); Terence J Yukio Higuchi, Redondo Beach, CA (US)

(73) Assignee: JAKKS Pacific, Incorporated, Malibu, CA (US)

( * ) Notice: Subject to any disclaimer, the term of this patent is extended or adjusted under 35 U.S.C. 154(b) by 311 days.

(21) Appl. No.: 11/341,405

(22) Filed: Jan. 26, 2006

(65) Prior Publication Data

US 2006/0211333 A1 Sep. 21, 2006

Related U.S. Application Data

(63) Continuation-in-part of application No. 11/183,118, filed on Jul. 14, 2005.

(60) Provisional application No. 60/730,080, filed on Oct. 24, 2005, provisional application No. 60/604,283, filed on Aug. 25, 2004.

(51) Int. Cl.
*A63H 17/00* (2006.01)
*A63H 17/28* (2006.01)
*A63H 17/32* (2006.01)

(52) U.S. Cl. ..... 446/429; 446/430; 446/38

(58) Field of Classification Search ..... 446/430, 446/429, 38, 39, 41

See application file for complete search history.

(56) References Cited

U.S. PATENT DOCUMENTS

| | | | | |
|---|---|---|---|---|
| D97,019 | S | 9/1935 | Sedivy | |
| D102,956 | S | 1/1937 | Prince | |
| 2,159,974 | A | 5/1939 | Lohr | |
| D144,077 | S | 3/1946 | Shaffer | |
| 2,551,982 | A | 5/1951 | Verkins | |
| D171,251 | S | 1/1954 | Courtney | |
| 2,697,306 | A | 12/1954 | Muller | |
| 2,788,613 | A | 4/1957 | Gelfand et al. | |
| 2,792,899 | A | 5/1957 | Piatti | |
| 3,124,007 | A | 3/1964 | Swinney | |
| 3,151,866 | A * | 10/1964 | Glass et al. | 446/39 |
| 3,236,323 | A | 2/1966 | Austin | |

(Continued)

FOREIGN PATENT DOCUMENTS

| | | | |
|---|---|---|---|
| GB | 2130903 A * | 6/1984 | |

(Continued)

*Primary Examiner*—Gene Kim
*Assistant Examiner*—Urszula M Cegielnik
(74) *Attorney, Agent, or Firm*—Tope-McKay & Associates

(57) ABSTRACT

Described is a toy vehicle with a launcher for connecting with and launching the toy vehicle. The toy vehicle includes a vehicle housing having a wheel opening in the housing for placement of a detachably attachable wheel and a vehicle strip opening for placement of a strip. A gear system is attached with the housing. The gear system includes gear teeth for engaging at least a part of the gear system with the strip. A rotating end is connected with the gear system for placement of a detachably attachable wheel. When the wheel is affixed with the rotating end, and when the strip is inserted into the vehicle strip opening and engaged with the gear teeth, a user may pull the strip and thereby cause the gear system to rotate the wheel so that the wheel spins and forces the vehicle to speed away from the launcher.

9 Claims, 23 Drawing Sheets

U.S. PATENT DOCUMENTS 3,237,342 A * 3/1966 Bross ..... 446/38
3,492,758 A 2/1970 Sato
3,520,080 A * 7/1970 Fairbairn ..... 446/465
3,701,216 A * 10/1972 Smith et al. ..... 446/429
D226,188 S 1/1973 Reed
3,735,526 A * 5/1973 Ensmann et al. ..... 446/429
D231,441 S 4/1974 Tratner
3,886,682 A 6/1975 Ieda et al.
3,895,458 A * 7/1975 Lemelson ..... 446/429
3,919,804 A * 11/1975 Nakata ..... 446/464
D238,158 S 12/1975 Mitchell
3,955,429 A 5/1976 Holden
4,053,029 A 10/1977 Darda
4,150,508 A * 4/1979 Ogawa ..... 446/473
4,201,011 A * 5/1980 Cook ..... 446/440
D258,426 S 3/1981 Dunan
4,293,052 A 10/1981 Daswick et al.
4,299,051 A * 11/1981 Pauly et al. ..... 446/471
4,309,841 A 1/1982 Asano
4,345,402 A 8/1982 Hanson et al.
4,363,186 A 12/1982 Goldfarb et al.
4,373,290 A 2/1983 Goldfarb et al.
D268,920 S 5/1983 Bragdon
4,387,604 A 6/1983 Maher
4,443,967 A 4/1984 Jones et al.
4,475,305 A 10/1984 Kawakami et al.
4,479,326 A * 10/1984 Kennedy et al. ..... 446/429
4,483,096 A 11/1984 Gabler et al.
D276,714 S 12/1984 Omholt
4,526,554 A 7/1985 Goldfarb et al.
4,529,055 A 7/1985 Gotoh et al.
4,529,389 A 7/1985 Kennedy et al.
4,547,174 A 10/1985 Lee et al.
4,556,396 A 12/1985 Kennedy et al.
4,571,212 A 2/1986 Kakizaki
4,659,320 A * 4/1987 Rich et al. ..... 446/435
4,683,986 A 8/1987 Darda et al.
4,685,894 A 8/1987 Beny et al.
4,709,774 A 12/1987 Saito et al.
4,732,569 A * 3/1988 Hippely et al. ..... 446/430
4,840,599 A * 6/1989 Ming ..... 446/465
4,887,688 A 12/1989 Horiike et al.
D305,415 S 1/1990 Miura et al.
4,946,417 A 8/1990 Ishikawa et al.
4,959,035 A 9/1990 Murasaki
D339,088 S 9/1993 Tako et al.
D340,757 S 10/1993 Chen
5,326,301 A 7/1994 Woodside
5,377,775 A 1/1995 Rush
5,380,231 A * 1/1995 Brovelli ..... 446/6
5,525,085 A * 6/1996 Liu ..... 446/23
5,525,086 A * 6/1996 Gentile et al. ..... 446/41
5,643,036 A 7/1997 Liu et al.
D396,433 S 7/1998 Belker et al.
5,803,790 A 9/1998 Tilbor et al.
5,823,848 A * 10/1998 Cummings ..... 446/429
D401,643 S 11/1998 Rey et al.
6,024,627 A 2/2000 Tilbor et al.
D431,611 S 10/2000 Dilabio et al.
6,227,934 B1 5/2001 Isaksson et al.
D455,678 S 4/2002 Schroeder et al.
D456,748 S 5/2002 Keating et al.
6,439,948 B1 8/2002 Ostendorff et al.
6,443,530 B1 * 9/2002 Lee ..... 301/37.25
6,540,583 B1 4/2003 Hoeting et al.
6,565,411 B1 5/2003 Fosbenner et al.
6,632,121 B2 * 10/2003 Edmisson et al. ..... 446/471
D482,301 S 11/2003 Chosa
D491,109 S 6/2004 Walters
6,854,547 B2 2/2005 Moll et al.
D503,361 S 3/2005 Everitt
D506,953 S 7/2005 Everitt et al.
2001/0004578 A1 6/2001 Jaffe
2003/0077979 A1 4/2003 Hoeting et al.
2003/0102657 A1 6/2003 Kuo
2006/0211331 A1 * 9/2006 Trageser ..... 446/429

FOREIGN PATENT DOCUMENTS

JP 58-86192 U * 11/1983
JP 2002089648 A * 3/2002
JP 2004229871 A * 8/2004

* cited by examiner

TOY VEHICLE WITH A DETACHABLY ATTACHABLE WHEEL

PRIORTY CLAIM

The present application is a Continuation-In-Part application, claiming the benefit of priority of U.S. patent application Ser. No. 11/183,118, filed Jul. 14, 2005, entitled "Toy for Rotating and Launching an Object," which is a non-provisional patent application claiming the benefit of priority of U.S. Provisional Patent Application No. 60/604,283, filed Aug. 25, 2004, entitled "Wheel Spinning Launcher and Wheel Toy." The present application also claims the benefit of priority of U.S. Provisional Application No. 60/730,080, filed Oct. 24, 2005, entitled, "Rotating Wheel/Propeller Toy," and of U.S. patent application Ser. No. 11/181,698, filed Jul. 13, 2005, entitled, "Remotely Controlled Vehicle with Detachably Attachable Wheels."

BACKGROUND OF THE INVENTION (1). Field of Invention

The present invention relates to a toy vehicle and, more particularly, to a toy vehicle having a detachably attachable wheel that is powered with a strip (i.e., ripcord).

(2). Description of Related Art

Toy vehicles have long been known in the art. Toy vehicles traditionally include four wheels and are powered through a variety of mechanisms and techniques. For example, some toy vehicles have no built-in propelling mechanism and are simply powered by a user as the user rolls the toy vehicle across a surface.

Other toy vehicles include a permanently affixed wheel and a ripcord. In such a configuration, a user may pull the ripcord to spin the wheel, thereby sending the toy vehicle speeding away from the user. However, in some circumstances it may be desirable to remove the wheel. Removal of the wheel would allow a user to replace the wheel with another wheel for both cosmetic and functional purposes. Additionally, a removed wheel could be used with other devices.

Thus, a continuing need exists for a toy vehicle that is powered by a ripcord to spin a quick-release detachably attachable wheel, where the wheel may be detached for use with other devices.

SUMMARY OF INVENTION

The present invention relates to a toy vehicle. The toy vehicle comprises:

- a vehicle housing having a wheel opening in the housing for placement of a detachably attachable wheel and a vehicle strip opening for placement of a strip;
- a gear system attached with the housing, the gear system having gear teeth for engaging at least a part of the gear system with the strip; and
- a rotating end connected with the gear system and being accessible via the wheel opening for placement of a detachably attachable wheel, the rotating end being configured to be detachably attached with the detachably attachable wheel, whereby when a detachably attachable wheel is placed within the wheel opening and affixed with the rotating end, and when the strip is inserted into the vehicle strip opening and engaged with the gear teeth, a user may pull the strip from the housing and thereby cause the gear system to rotate the rotating end and the detachably attachable wheel so that the detachably attachable wheel spins and forces the vehicle to speed away from the user.

In another aspect, the toy vehicle further comprises a detachably attachable wheel for placement within the wheel opening, the wheel having a central rotor for engaging with the rotating end.

In another aspect, the present invention further comprises a strip having teeth, the strip being adapted to be inserted into the strip opening and engage with the gear teeth.

In yet another aspect, the present invention further comprises a launcher for connecting with and launching the toy vehicle.

In another aspect, the launcher further comprises a spring-loaded attachment mechanism and a trigger operably connected with the spring-loaded attachment mechanism, and wherein the toy vehicle further comprises an attachment member for attaching with the spring-loaded attachment mechanism, whereby a user may attach the toy vehicle with the launcher and use the strip to rotatably accelerate the detachably attachable wheel, and upon squeezing the trigger the toy vehicle is launched from the launcher after which the detachably attachable wheel engages with a ground surface to cause the toy vehicle to speed away from the launcher.

In another aspect, the toy vehicle further comprises a quick release apparatus for attaching with and locking the detachably attachable wheel to the toy vehicle.

Additionally, each detachably attachable wheel further comprises a receiving element, the receiving element including a notch and driving edge formed therein.

Furthermore, the quick release apparatus further comprises:

- a slide switch attached with the vehicle housing;
- a drum having tabs attached with the vehicle housing;
- a withdrawing member attached with the vehicle housing and operably connected with the slide switch, the withdrawing member having a catch for engaging with a driving edge of the receiving element, whereby a detachably attachable wheel may be attached with the quick release apparatus by sliding the receiving element into the drum such that the tab slides within the notch, the catch thereafter engaged with the driving edge, and when detaching the detachably attachable wheel, the slide switch is used to withdraw the withdrawing member such that the catch is withdrawn from the driving edge, thereby allowing the tab to be slid out of the notch which results in the removal of the detachably attachable wheel.

Additionally, the launcher is formed to hold the detachably attachable wheel off of a ground surface when the toy vehicle is attached with the launcher.

In another aspect, the housing has a front portion and a rear portion, and where the wheel opening is formed at the rear portion for placement of the detachably attachable wheel therein.

In another aspect, the present invention further comprises a flywheel attached with the gear system, the flywheel having weight such that as the strip is pulled from the gear system to rotate the rotating end to have a rotational momentum, the weight of the flywheel increases the rotational momentum.

Additionally, the detachably attachable wheel is formed to be used with a device other than the toy vehicle.

In another aspect, the device other than the toy vehicle is a hand launcher for launching the detachably attachable wheel.

Finally, as can be appreciated by one in the art, the present invention also comprises a method for forming and using the toy vehicle described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
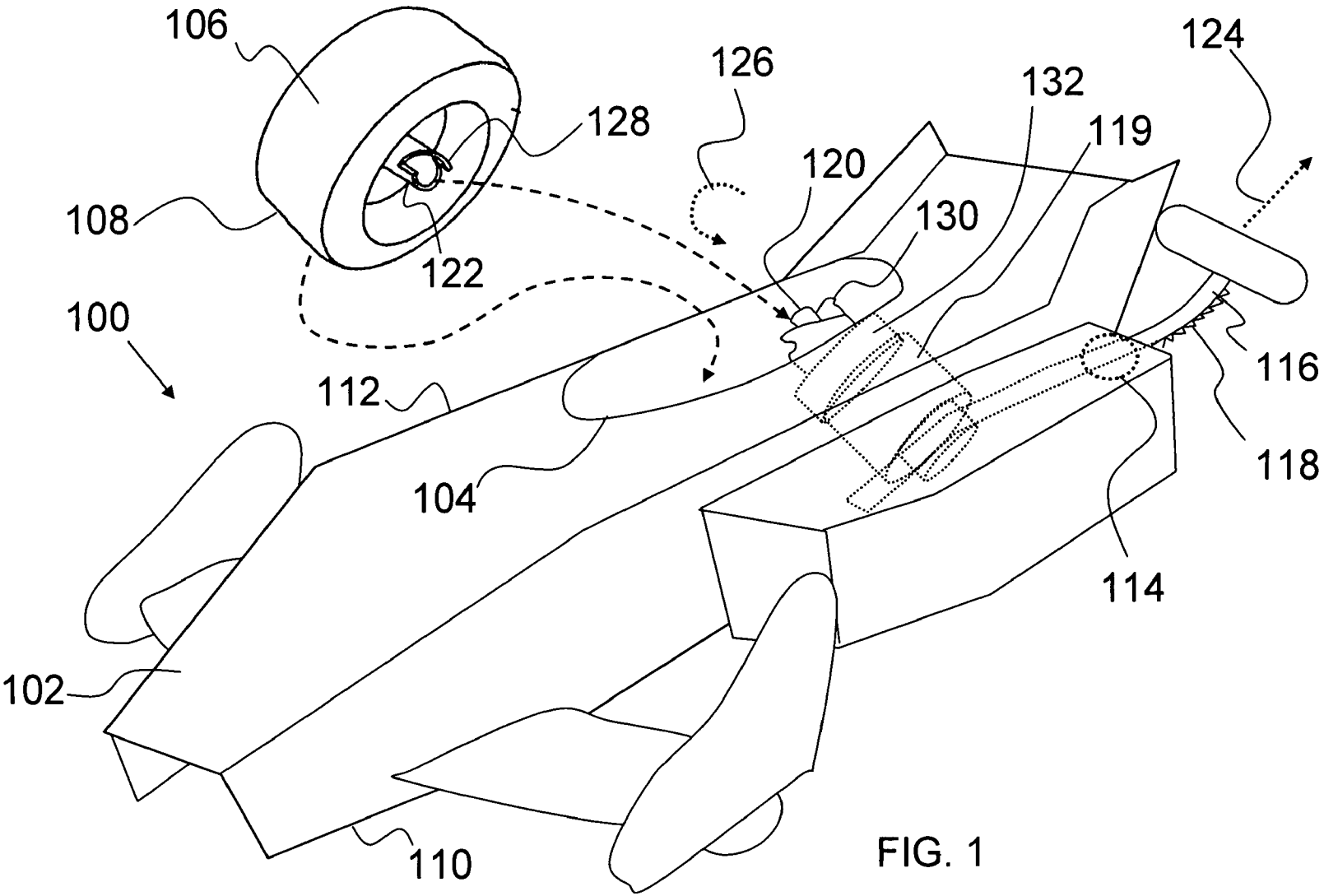
FIG. 1 is a perspective-view illustration of a toy vehicle according to the present invention.

The present invention relates to a toy vehicle and, more particularly, to a toy vehicle having an interchangeable wheel that is powered with a pull cord. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention.

However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6.In particular, the use of "step of" or "act of" in the claims herein is not intended to invoke the provisions of 35 U.S.C. 112, Paragraph 6.

Note, the labels left, right, front, back, top, bottom, forward, reverse, clockwise and counter clockwise have been used for convenience only and are not intended to imply any particular fixed direction. Instead, they are used to reflect relative locations and/or directions between various portions of an object. As such, as the present invention is turned around and/or over, the above labels may change their relative configurations.

Before describing the invention in detail, an introduction is provided to provide the reader with a general understanding of the present invention. Next, a description of various aspects of the present invention is provided to give an understanding of the specific details.

(1) Introduction

The present invention relates to a toy vehicle and having a launcher. The toy vehicle includes a wheel opening for placement of the detachably attachable wheel. Through use of a strip, a user may spin the detachably attachable wheel and force the vehicle to speed away from the user. Additionally, a launcher can be attached with the toy vehicle to launch the toy vehicle after having spun the detachably attachable wheel. The detachably attachable wheel can also be utilized with other devices such as toy for rotating and launching an object. The toy for rotating and launching an object allows a user to attach the wheel with the launcher and thereby launch the detachably attachable wheel. For clarity purposes, the present invention will be described in two sections, the first describing various aspect of the toy vehicle with the second describing the toy for rotating and launching an object.

(2.1) Toy Vehicle

As shown in FIG. 1, the present invention relates to a toy vehicle 100. The toy vehicle 100 includes a vehicle housing 102 with a wheel opening 104. The vehicle housing 102 is formed of a suitably rigid material, a non-limiting example of which includes plastic. Additionally, the vehicle housing 102 can be formed to represent a variety of objects, non-limiting examples of which include a race car (shown), an animal, a space ship, and an airplane.

The wheel opening 104 is formed to allow for placement of a detachably attachable wheel 106 therein such that a peripheral portion 108 of the detachably attachable wheel 106 extends beyond a bottom portion 110 of the vehicle housing 102. It can be appreciated by one skilled in the art that although FIG. 1 illustrates the wheel opening 104 on a top portion 112 of the vehicle housing 102, this is an optional feature, with the only necessity being that the wheel opening 104 allows the detachably attachable wheel 106 to extend beyond the bottom portion 110 to engage with a ground surface.

A strip opening 114 is formed in the vehicle housing 102 to allow for placement of a strip 116. The strip 116 (i.e., ripcord) has teeth 118 on at least one side of a longitudinally extending strip-like surface. The strip 116 is formed to be passed through the strip opening 114 in the vehicle housing 102 and engage with a gear system 119 therein.

The gear system 119 is attached with the vehicle housing 102 and includes gear teeth for engaging with the strip 116 and gears within the gear system 119. P A rotating end 120 is connected with the gear system 119 for detachably attaching with a central rotor 122 on the detachably attachable wheel 106. As described in further detail below, the gear system 119 is configured such that as a user pulls the strip 116 away 124 from the vehicle housing 102, the rotating end 120 spins in a forward direction 126. By attaching the detachably attachable wheel 106 with the rotating end 120, a user may pull the strip 116 to spin the detachably attachable wheel 106 in a forward direction 126 and thereby cause the vehicle 100 to speed away from the user.

A detachably attachable wheel 106 is included for attaching with the vehicle 100. The detachably attachable wheel 106 includes a central rotor 122 that is formed in a suitable manner to be attached with the rotating end 120. As a non-limiting example, the central rotor 122 includes a wheel engagement apparatus 128 (e.g., a hook-shape) that is formed to engage with a corresponding rotating-end engagement apparatus 130 (e.g., a hook-shape), such that as the rotating end 120 rotates, the rotating-end engagement apparatus 130 engages with the wheel engagement apparatus 128 to cause the detachably attachable wheel 106 to spin.

Once spinning, both the rotating end 120 and the detachably attachable wheel 106 have a rotational momentum. To increase the rotational momentum, a flywheel 132 is attached with the rotating end 120. The flywheel 132 is weighted such that as the strip 116 is pulled from the gear system 119 to rotate the rotating end 120 and the attached flywheel 132, the weight of the now spinning flywheel 132 increases the rotational momentum. Through an increased rotational momentum, the toy vehicle 100 is able to travel farther and faster. The flywheel 132 may be permanently affixed with the rotating end 120, or may be formed such that it is detachably attachable with the rotating end 120 (described in further detail below). Additionally, as can be appreciated by one in the art, the flywheel 132 may be encased within the vehicle housing 102, or be formed such that it is exposed within the wheel opening 104.

Figure 2:
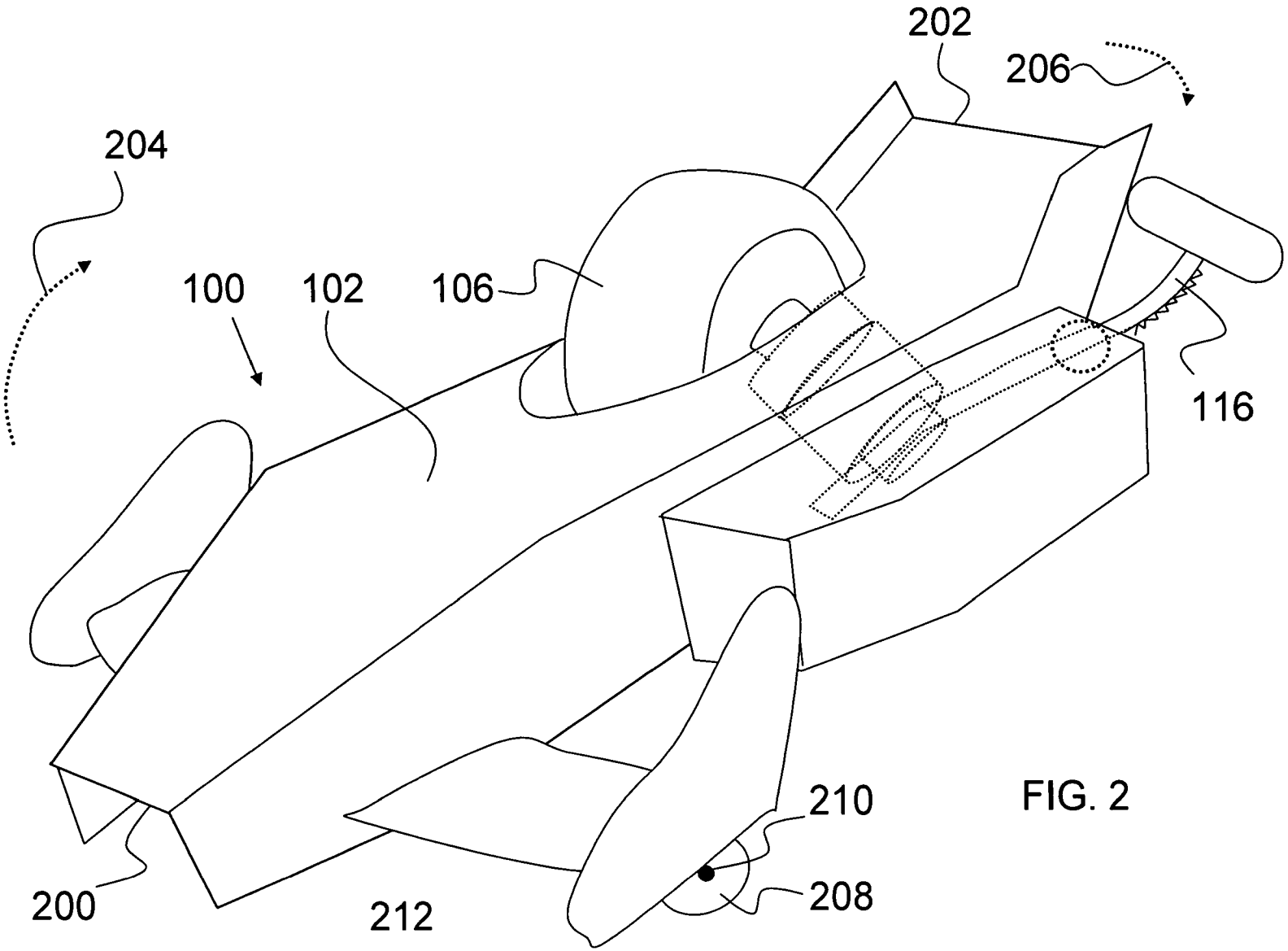
FIG. 2 is a perspective-view illustration of the toy vehicle according to the present invention, showing a detachably attachable wheel attached with the toy vehicle.

FIG. 2 illustrates a detachably attachable wheel 106 attached with the toy vehicle 100. As described above, once the wheel 106 is attached, a user may pull the strip 116 to spin the detachably attachable wheel 106.

The vehicle housing 102 includes a front portion 200 and a rear portion 202. Although the wheel opening 104 may be formed along any axial point between the front 200 and rear 202 portions, it is preferable that the wheel opening 104 be formed proximate the rear portion 202. Once the wheel 106 is spun and placed upon a surface, a lifting force 204 is applied to the front portion 200 to decrease vehicle friction (e.g., drag) with the surface. In the alternative, if the wheel opening 104 were formed proximate the front portion 200, a downward force 206 would be applied to the rear portion 202, thereby increasing vehicle friction with the surface.

As an optional feature, an additional wheel 208 may be attached with the housing 102. The additional wheel 208 is rotationally mounted on an axle 210, with the axle 210 being attached with the vehicle housing 102 at any suitable location. In a desirable aspect, the additional wheel 208 is attached proximate the front portion 200 to further reduce vehicle friction with the surface.

As both a cosmetic and functional feature, an air wing 212 may be optionally attached with the housing 102 proximate the front portion 200. When the vehicle 100 is in motion, the air wing 212 assists in reducing the lifting force 204.

Figure 3:
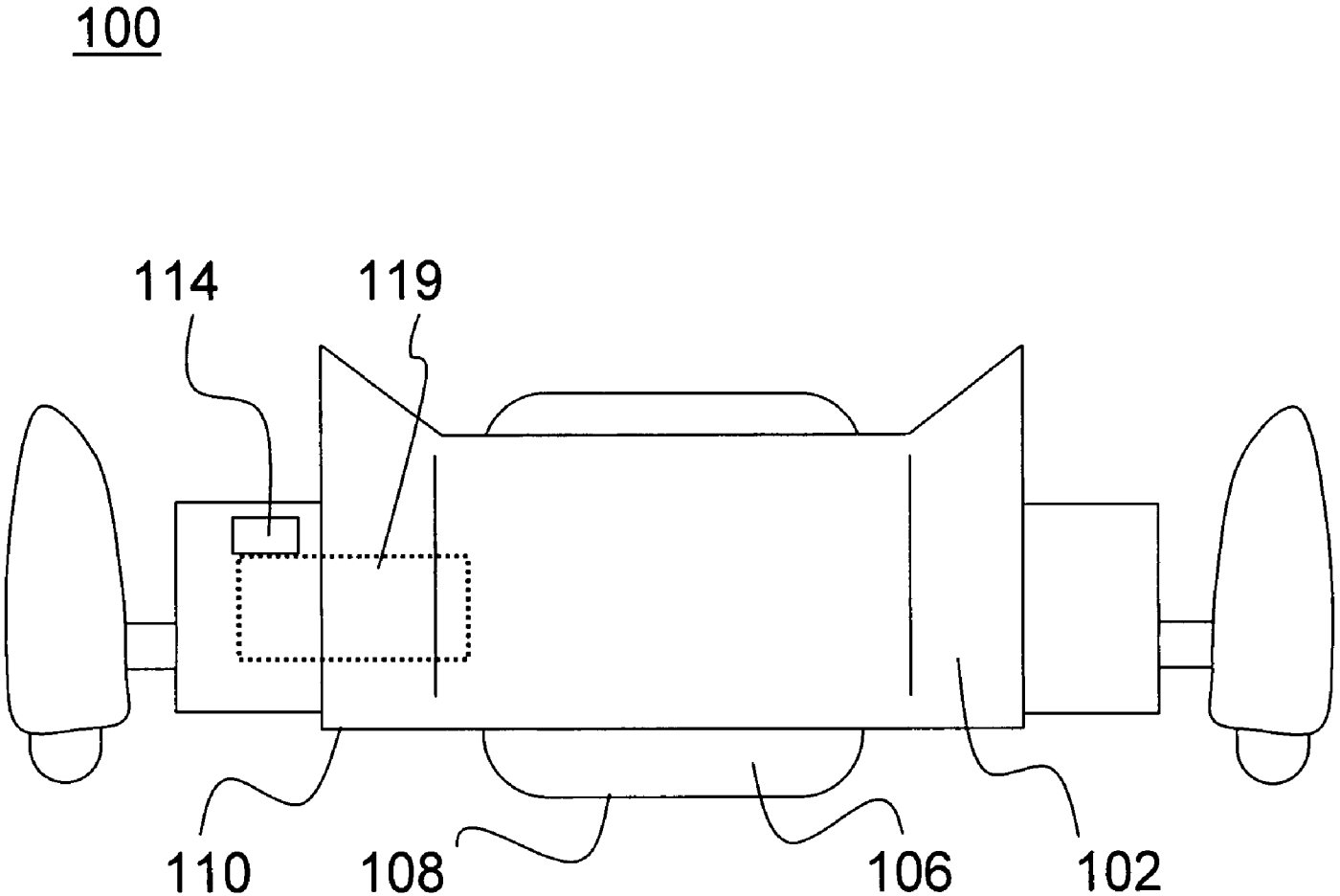
FIG. 3 is rear-view illustration of the toy vehicle according to the present invention.
Figure 4:
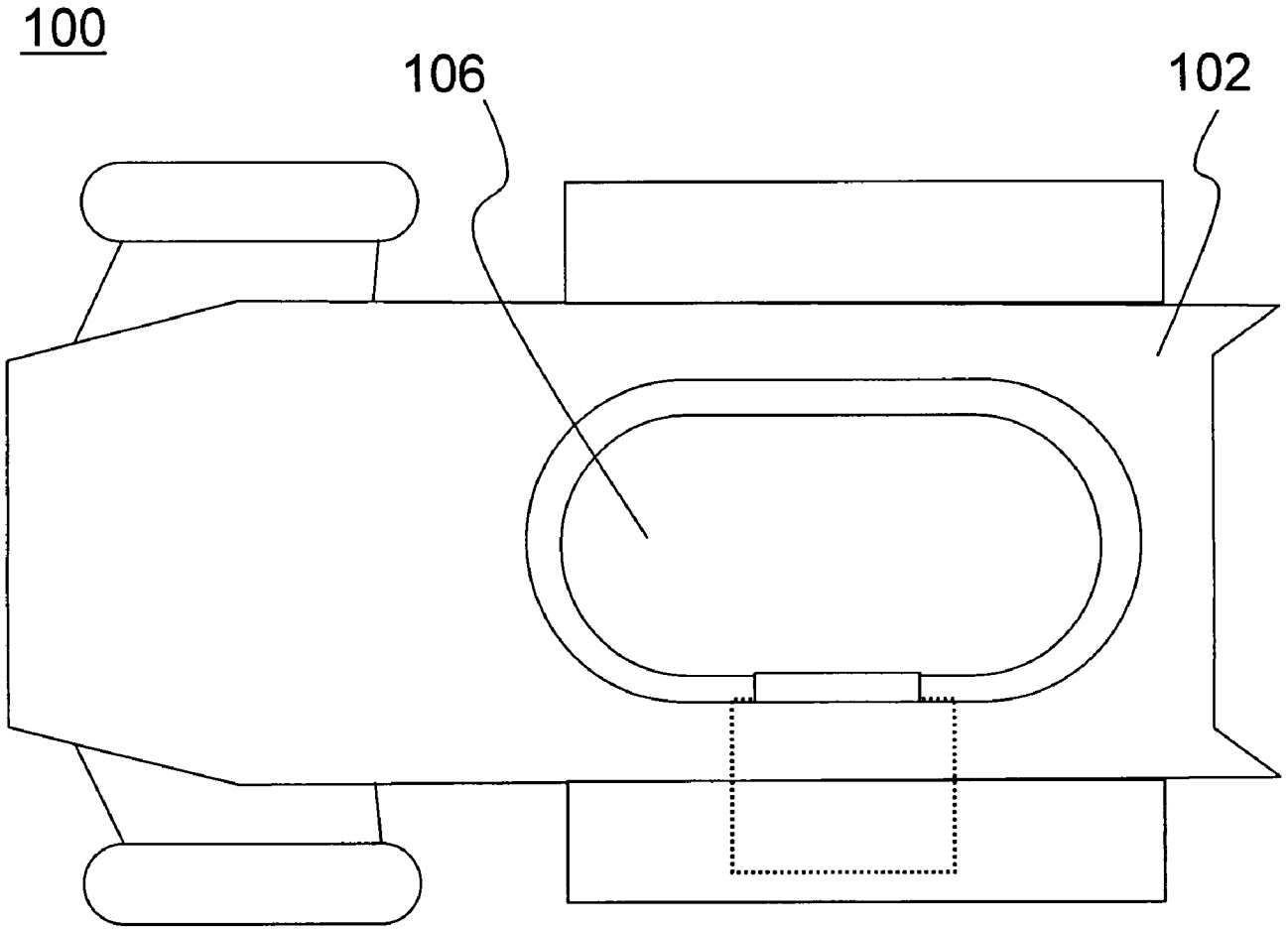
FIG. 4 is top-view illustration of the toy vehicle according to the present invention.
Figure 5:
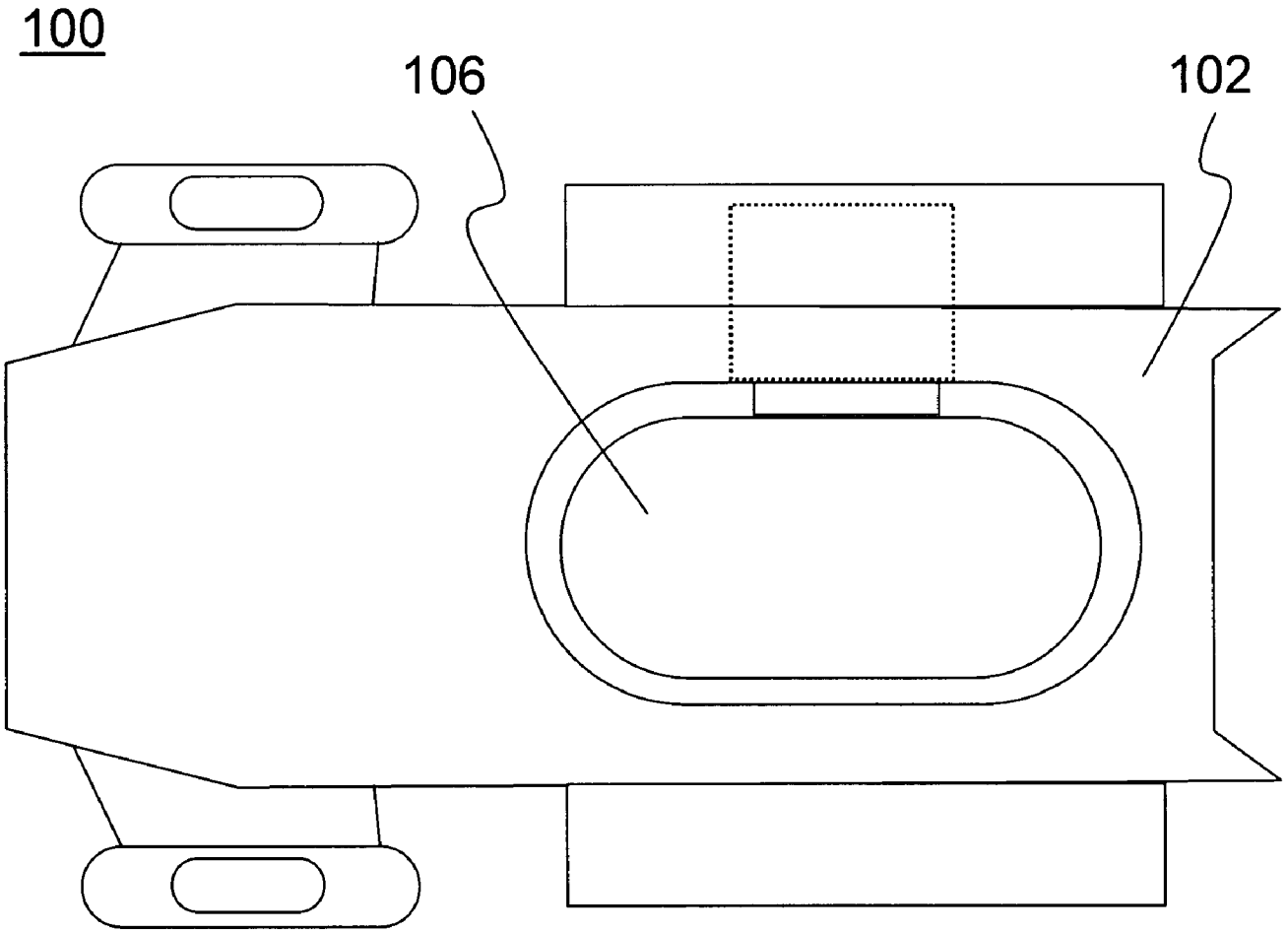
FIG. 5 is bottom-view illustration of the toy vehicle according to the present invention.
Figure 6:
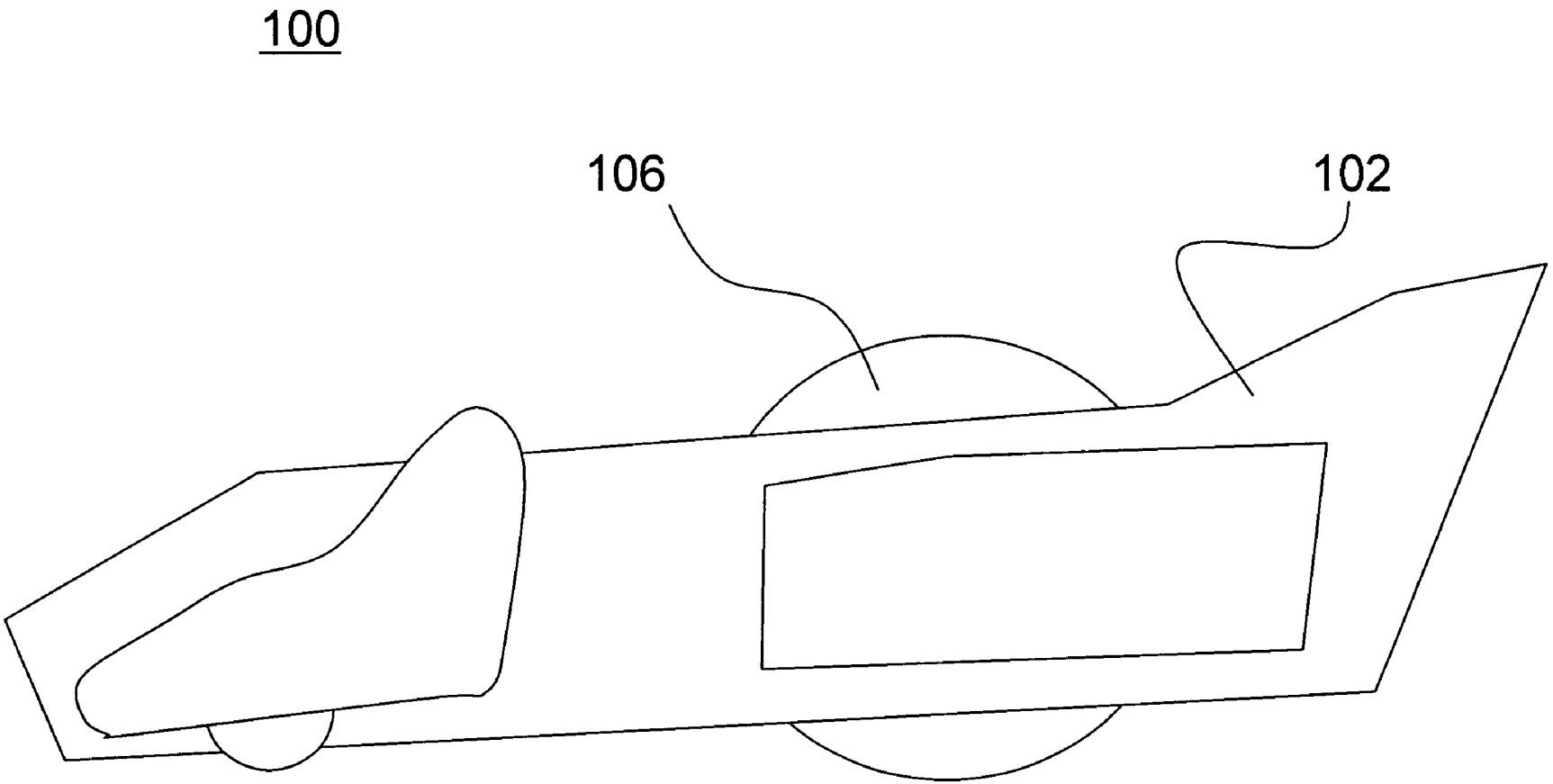
FIG. 6 is side-view illustration of the toy vehicle according to the present invention.

For further illustration, FIGS. 3 through 6 illustrate various viewpoints of the toy vehicle 100, showing the detachably attachable wheel 106 affixed with the vehicle housing 102. FIG. 3 is a rear-view illustration; FIG. 4 is a side-view illustration; FIG. 5 is a top-view illustration; and FIG. 6 is a bottom-view illustration.

As shown in FIG. 3, a strip opening 114 is formed in the vehicle housing 102 to allow an inserted strip to engage with the gear system 119. Additionally, as shown in the rear and side-views of FIGS. 3 and 4 respectively, the peripheral portion 108 of the detachably attachable wheel 106 extends beyond the bottom portion 110 of the vehicle housing 102, thereby enabling the wheel 106 to engage with the ground surface.

Figure 7:
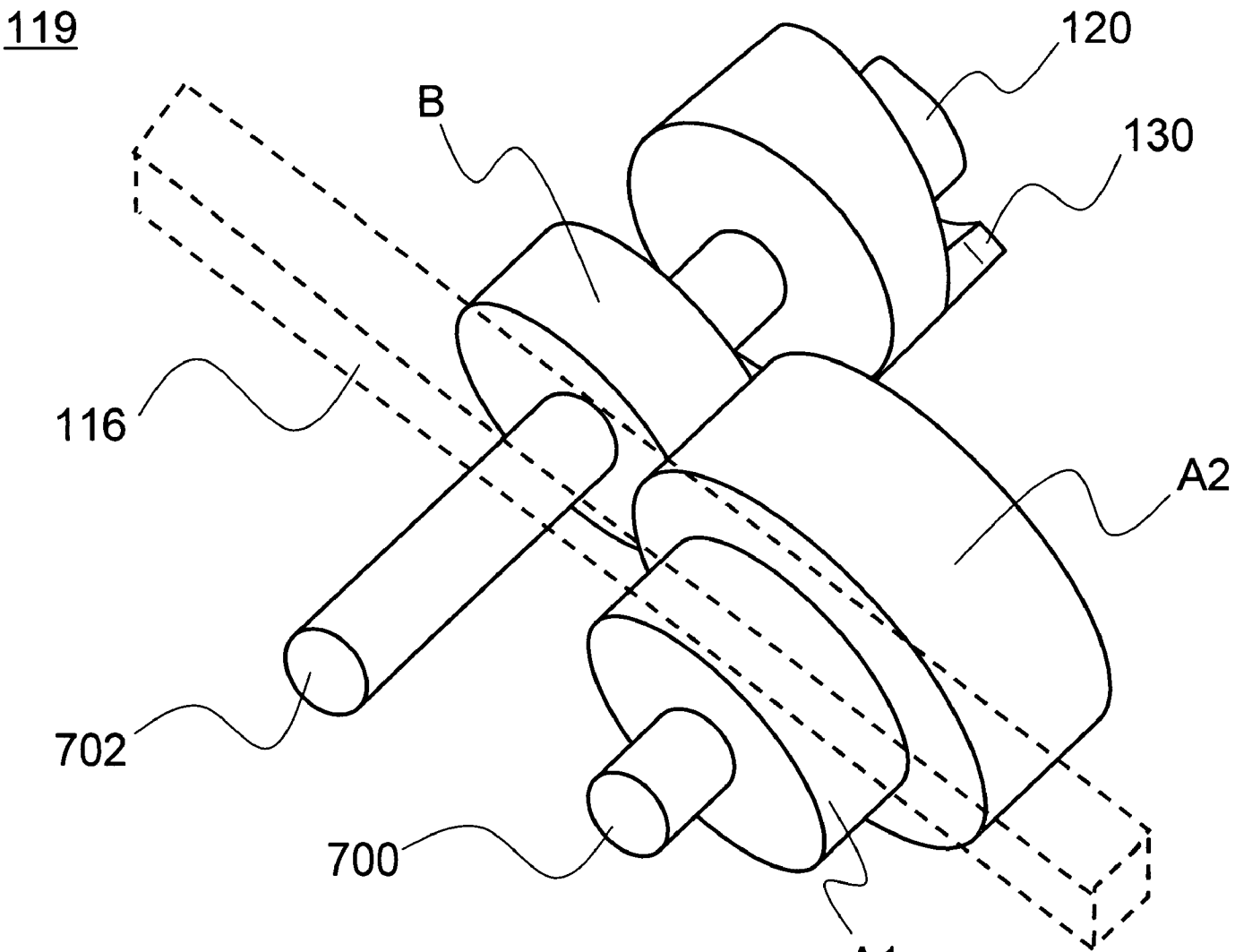
FIG. 7 is an illustration of a gear system according to the present invention.
Figure 8:
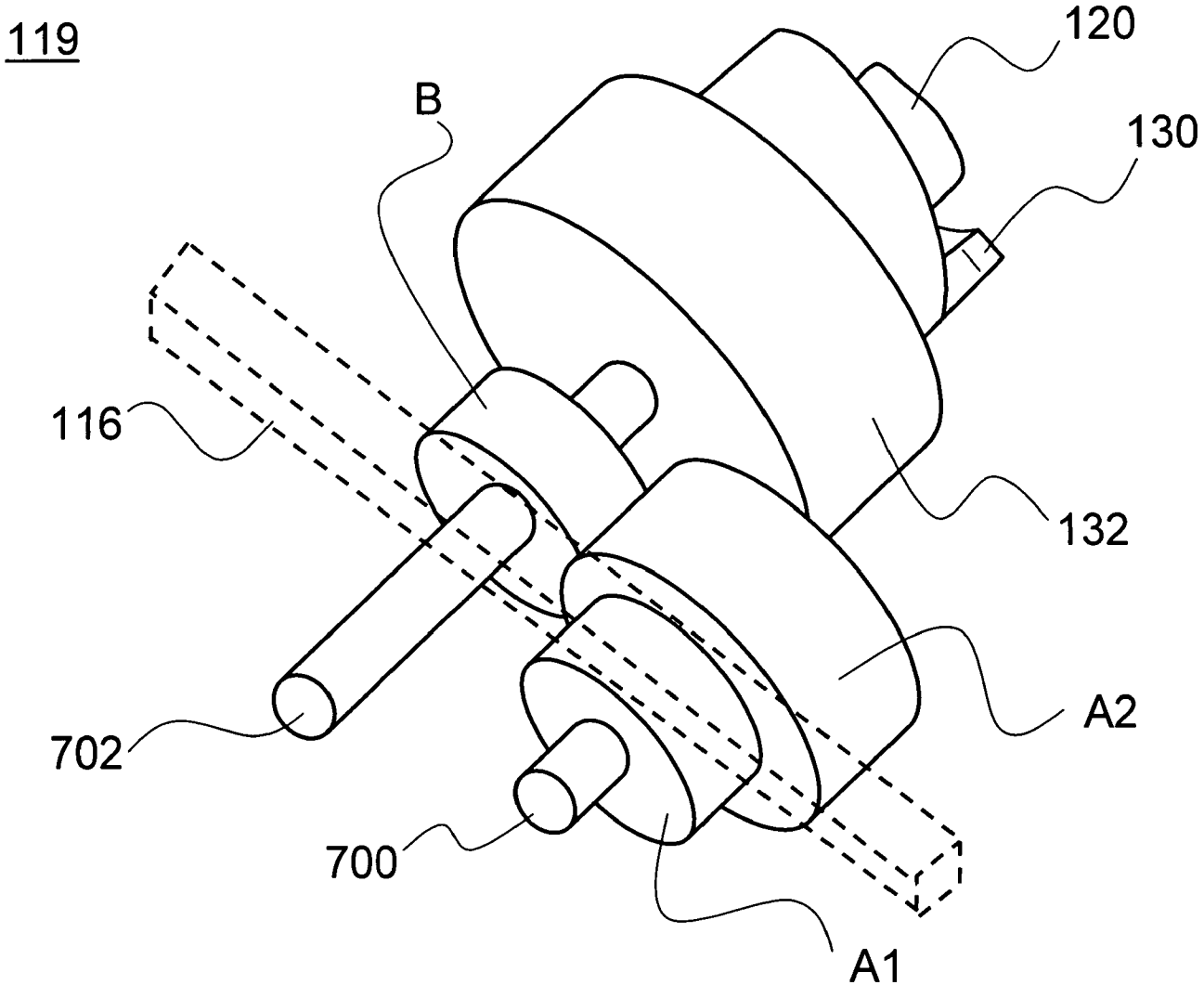
FIG. 8 is an illustration of a gear system according to the present invention, showing a flywheel attached with a rotating end.
Figure 9:
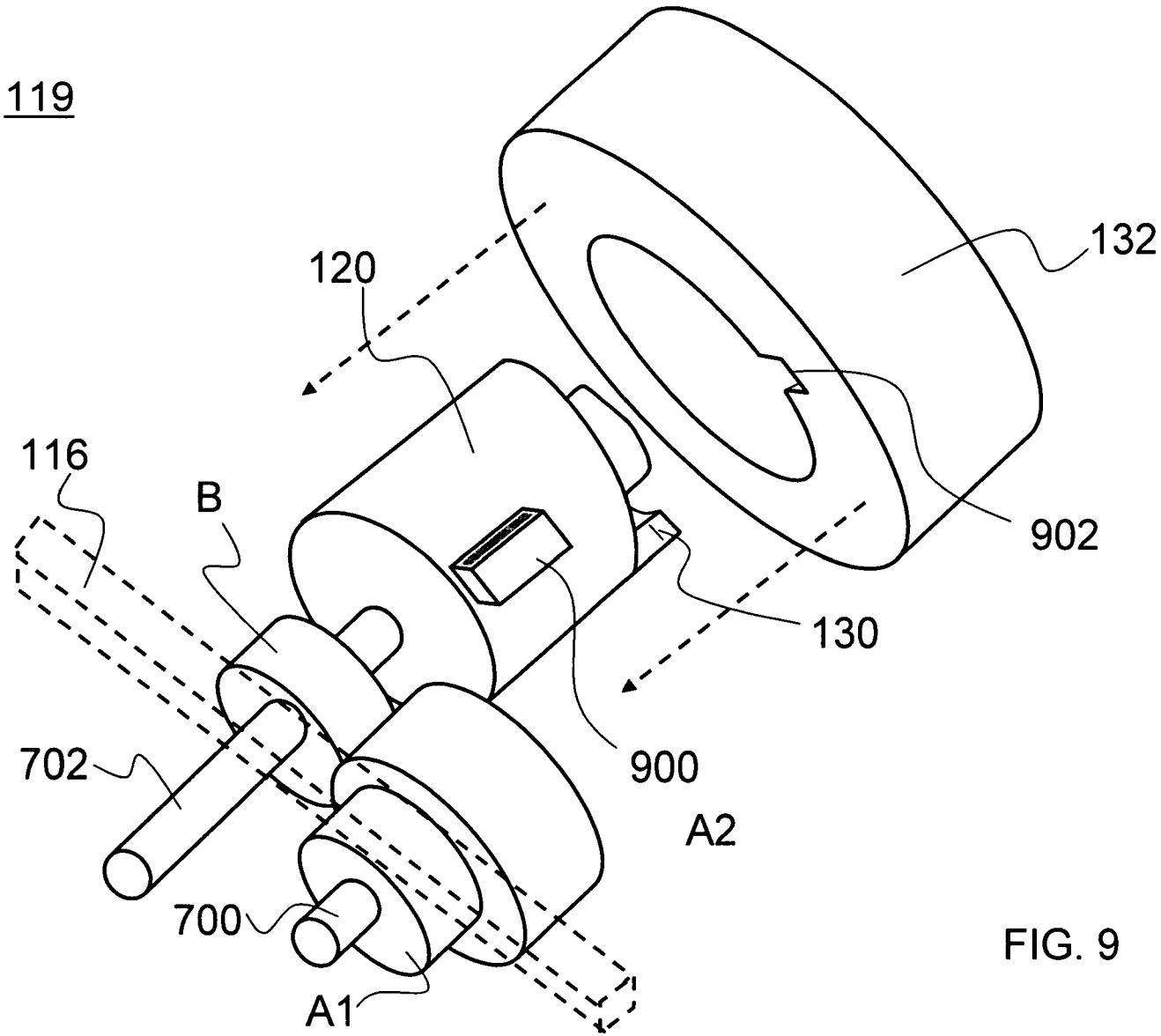
FIG. 9 is an illustration of a gear system according to the present invention, showing a detachably attachable flywheel.

FIGS. 7 through 9 illustrate the gear system 119 according to the present invention. As can be appreciated by one skilled in the art, the gears described herein include gear teeth (not shown). As shown in FIGS. 7 through 9, the gear system 119 includes a plurality of gears. In operation, the strip 116 is inserted through the strip opening into the gear system 119. The teeth (not shown) on the strip 116 engage with the teeth on gear A1. Working on the same axle 700, the strip 116 drives the combination of gears A1 and A2. The rotating end 120 and gear B work together on the same axle 702, such that the rotating end 120 rotates in the same direction as gear B when gear B is rotated.

Both the rotating end 120 and gear B's rotation are slow when the strip 116 is slowly introduced into the gear system 119. When the strip 116 is pulled from the gear system 119, all the gears in the gear system 119 engage. When the strip 116 is pulled from the gear system 119, gears A1 and A2 rotate. Gear A2 drives gear B, which causes the rotating end 120 to rotate. The gears will continue to rotate as the strip 116 is pulled out of and away from the gear system 119. As the gears rotate, the rotating-end engagement apparatus 130 causes an attached detachably attachable wheel to spin and thereby cause the toy vehicle to speed away from the user.

As shown in FIG. 8, a flywheel 132 is attached with the rotating end 120 to increase the rotational momentum once the flywheel 132 is in motion. The flywheel 132 shares the same axle 702 as gear B and the rotating end 120, such that as gear B spins, both the flywheel 132 and the rotating end 120 spin.

In some cases, it may be desirable to remove and replace the flywheel 132. Accordingly and as shown in FIG. 9, the flywheel 132 is detachably attachable with the rotating end 120. As can be appreciated by one skilled in the art, there are a variety of techniques for detachably attaching the flywheel 132 with the rotating end 120. As a non-limiting example, a ridge 900 is formed on the rotating end 120, with a corresponding notch 902 formed in the flywheel 132. Through use of the ridge 900 and notch 902, a user may selectively attach/detach the flywheel 132 as desired.

Figure 10:
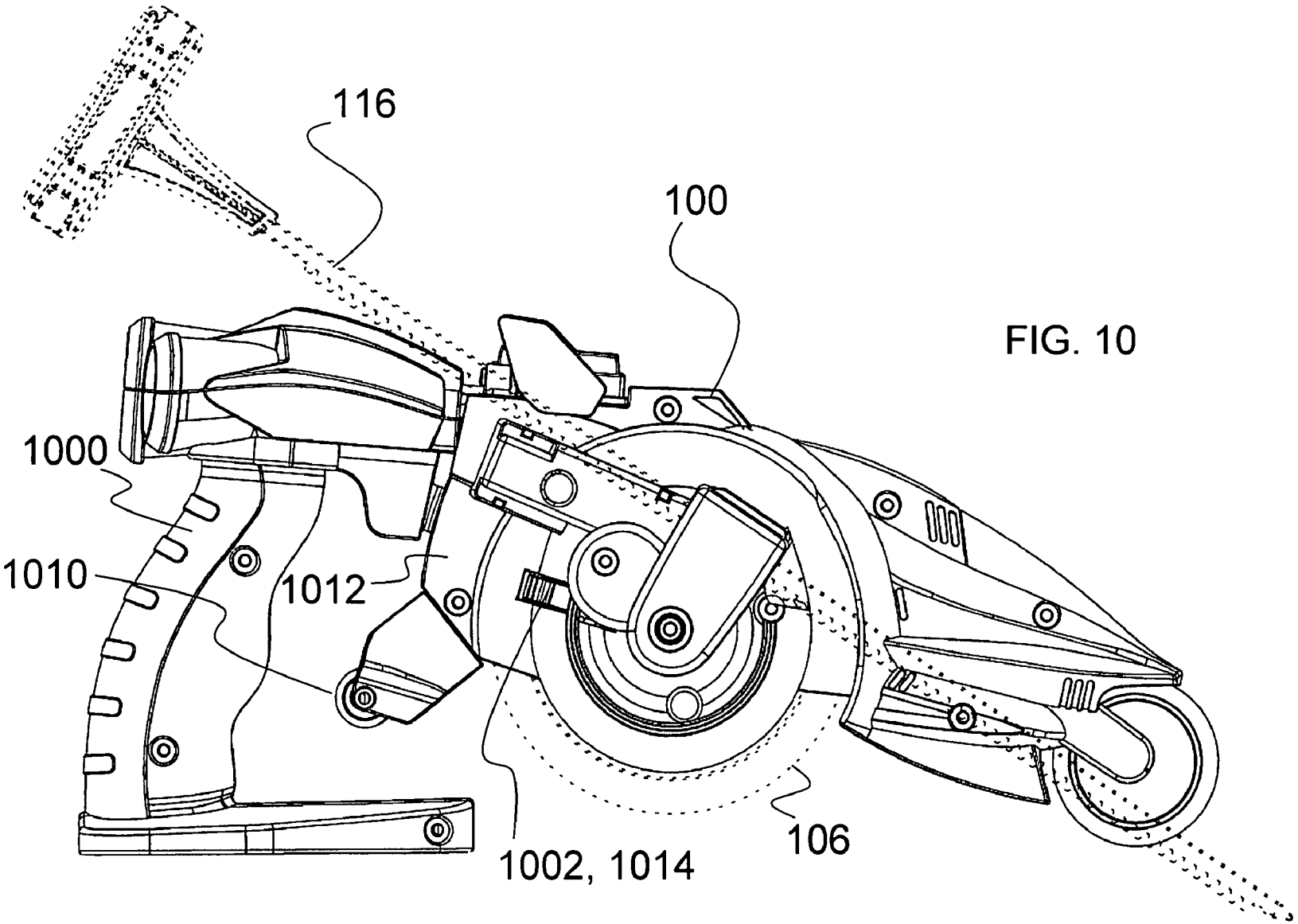
FIG. 10 is a right, side-view illustration of another aspect of the toy vehicle according to the present invention, including a launcher for launching the toy vehicle.
Figure 11:
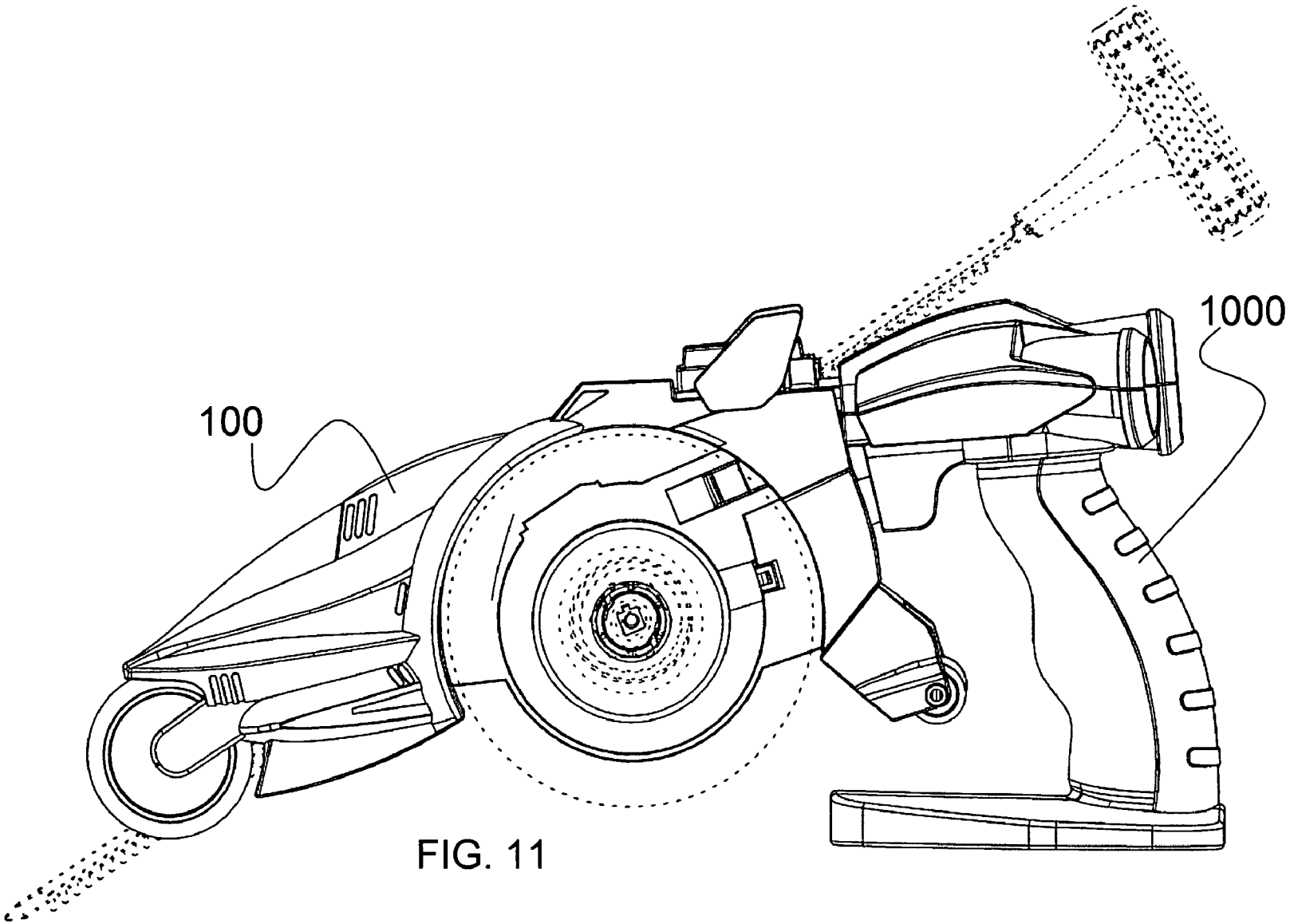
FIG. 11 is a left, side-view illustration of another aspect of the toy vehicle according to the present invention, illustrating an opening in the toy vehicle for placement of the wheel.

In another aspect, and as shown in FIG. 10, the toy vehicle 100 also includes a launcher 1000. FIG. 10 is a right, side-view illustration of the toy vehicle 100 attached with the launcher 1000. The strip 116 and detachably attachable wheel 106 have been illustrated with dashed lines in order to further illustrate the present invention. Also shown is a stabilization wheel 1010. The stabilization wheel 1010 is affixed with the toy vehicle proximate its rear portion 1012. Because of the high velocity of the detachably attachably wheel 106, it may be possible that upon release, the toy vehicle 100 pulls a wheelie and flips over. To prevent the toy vehicle from flipping over, the stabilization wheel 1010 keeps the front end of the toy vehicle near the ground surface. For another perspective, FIG. 11 is a left, side-view illustration of the vehicle 100 attached with the launcher.

The launcher is 1000 is formed to connect with and launch the toy vehicle 100. As shown in FIGS. 12 through 16, the launcher 1000 includes a spring-loaded attachment mechanism 1002 and a trigger 1004 operably connected with the spring-loaded attachment mechanism 1002. The spring-loaded attachment mechanism 1002 is any suitable mechanism for selectively attaching and detaching with an attachment member. Additionally, the trigger 1004 is any suitable mechanism capable of actuating the spring loaded attachment mechanism 1002. Furthermore, the toy vehicle includes an attachment member 1006 for attaching with the spring-loaded attachment mechanism 1002. Using the aforementioned, a user may attach the toy vehicle 100 with the launcher 1000 and use the strip to rotatably accelerate the detachably attachable wheel (not shown in FIGS. 12 through 16). Upon squeezing the trigger 1004, the toy vehicle 100 is launched from the launcher 1000, after which the detachably attachable wheel engages with a ground surface to cause the toy vehicle 100 to speed away from the launcher 1000.

In another aspect, the trigger 1004 is non-functional and is for aesthetic purposes only. In this aspect, the spring loaded attachment mechanism 1002 is simply a spring without any attachment mechanism. When the attachment member 1006 is engaged with the spring, use of the strip pulls the toy vehicle towards the handle 1000, thereby compressing the spring. When the strip is pulled out of the toy vehicle 100, the spring expands to force the toy vehicle 100 vehicle away from the handle 1000, thereby helping to overcome the initial inertia of the toy vehicle 100 so it will roll farther (i.e., less energy is consumed trying to get the vehicle initially rolling).

Figure 12:
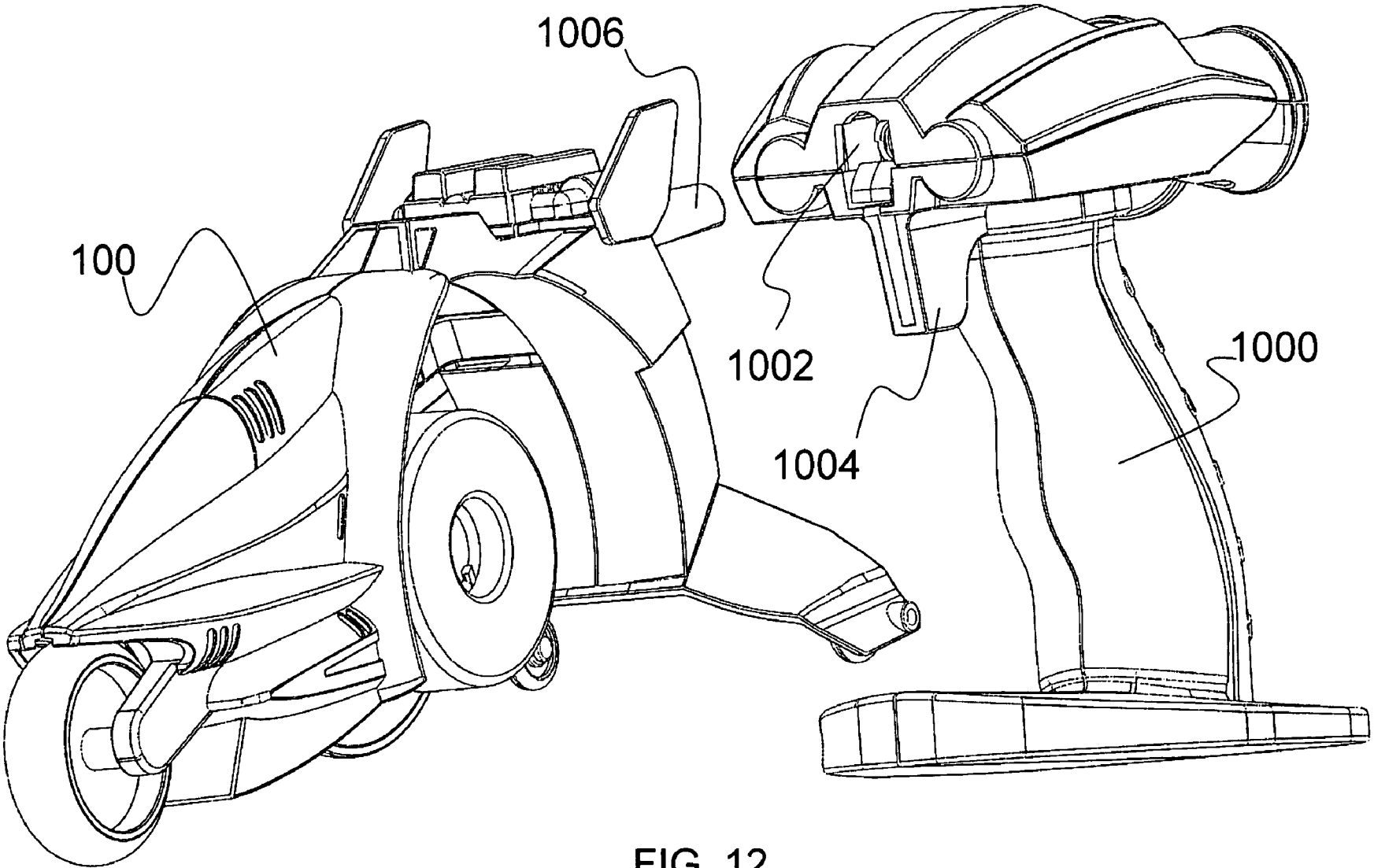
FIG. 12 is a front perspective-view illustration of the toy vehicle and the launcher according to the present invention.
Figure 13:
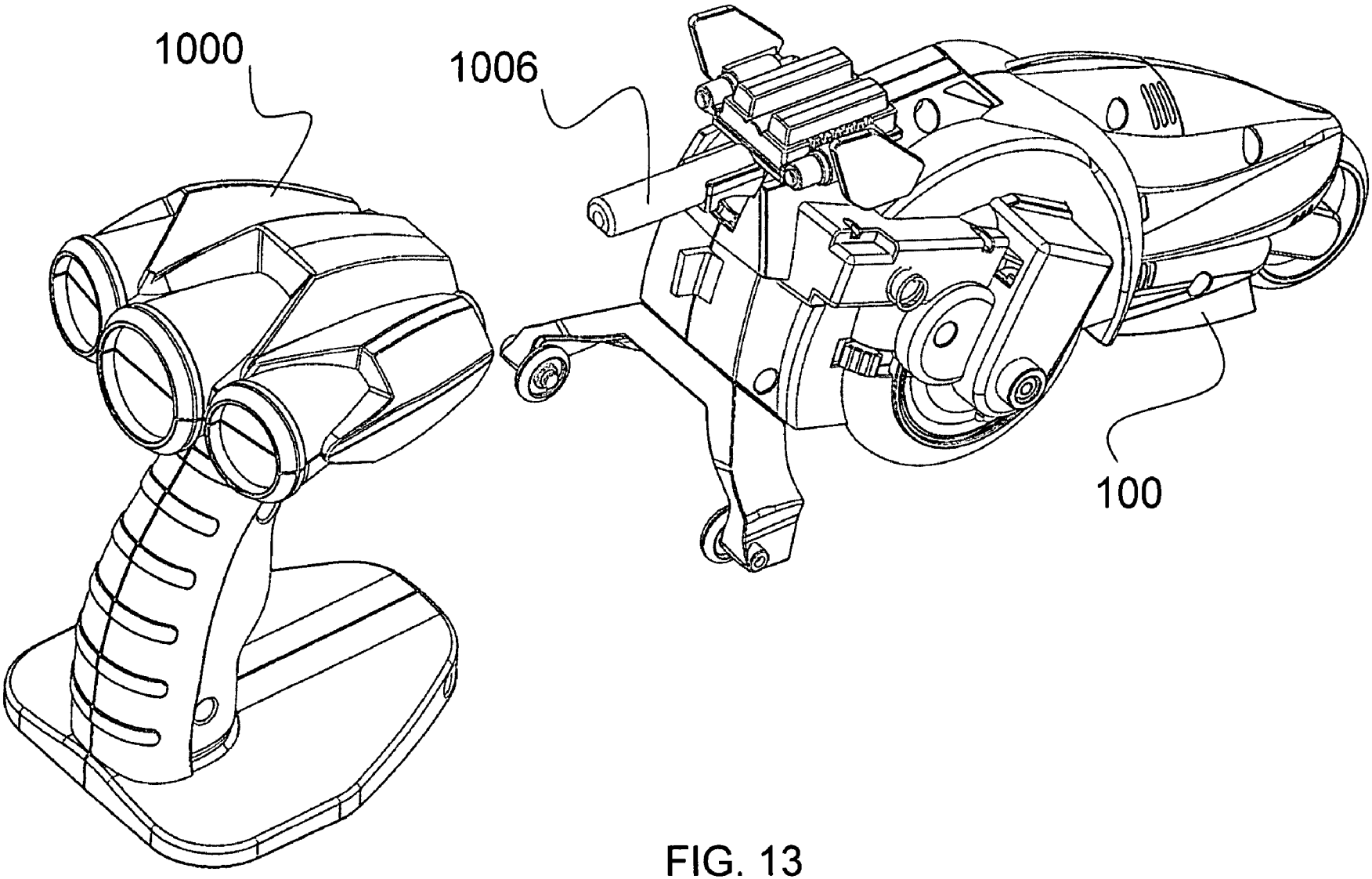
FIG 13 is a rear perspective-view illustration of the toy vehicle and the launcher according to the present invention.
Figure 14:
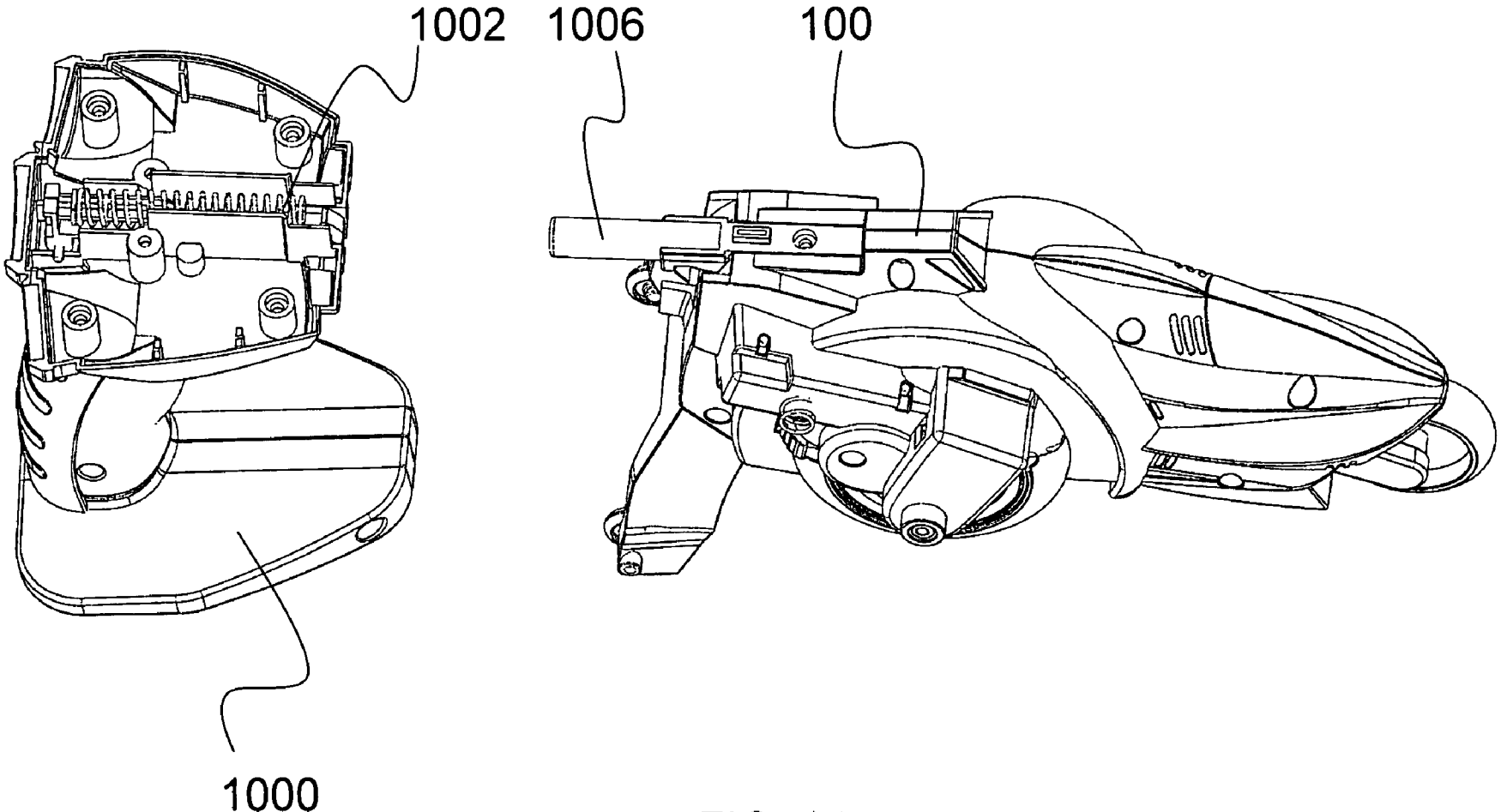
FIG. 14 is an illustration of the toy vehicle and of an interior of the launcher.
Figure 15:
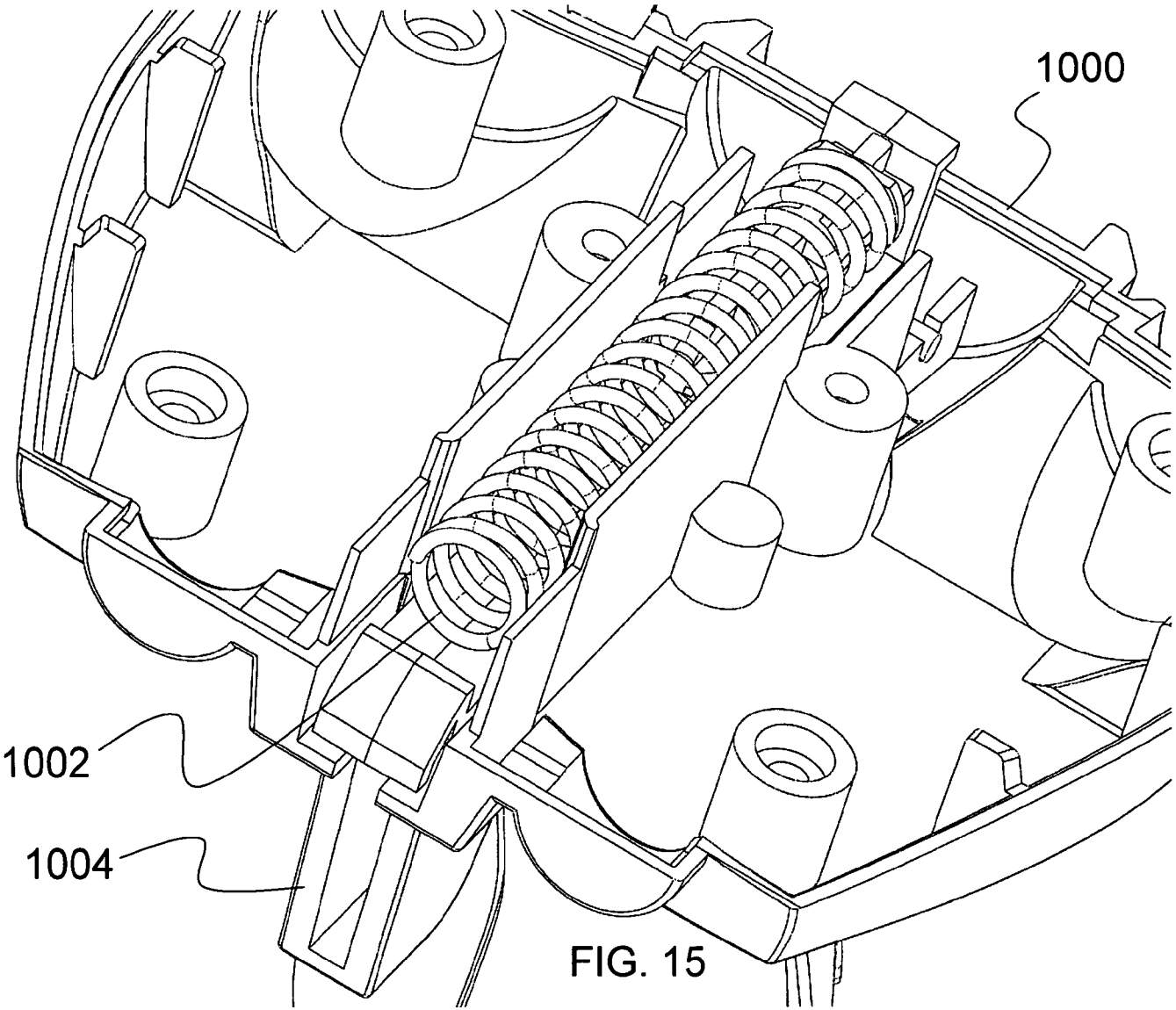
FIG. 15 is a close-up view illustration of the interior of the launcher.
Figure 16:
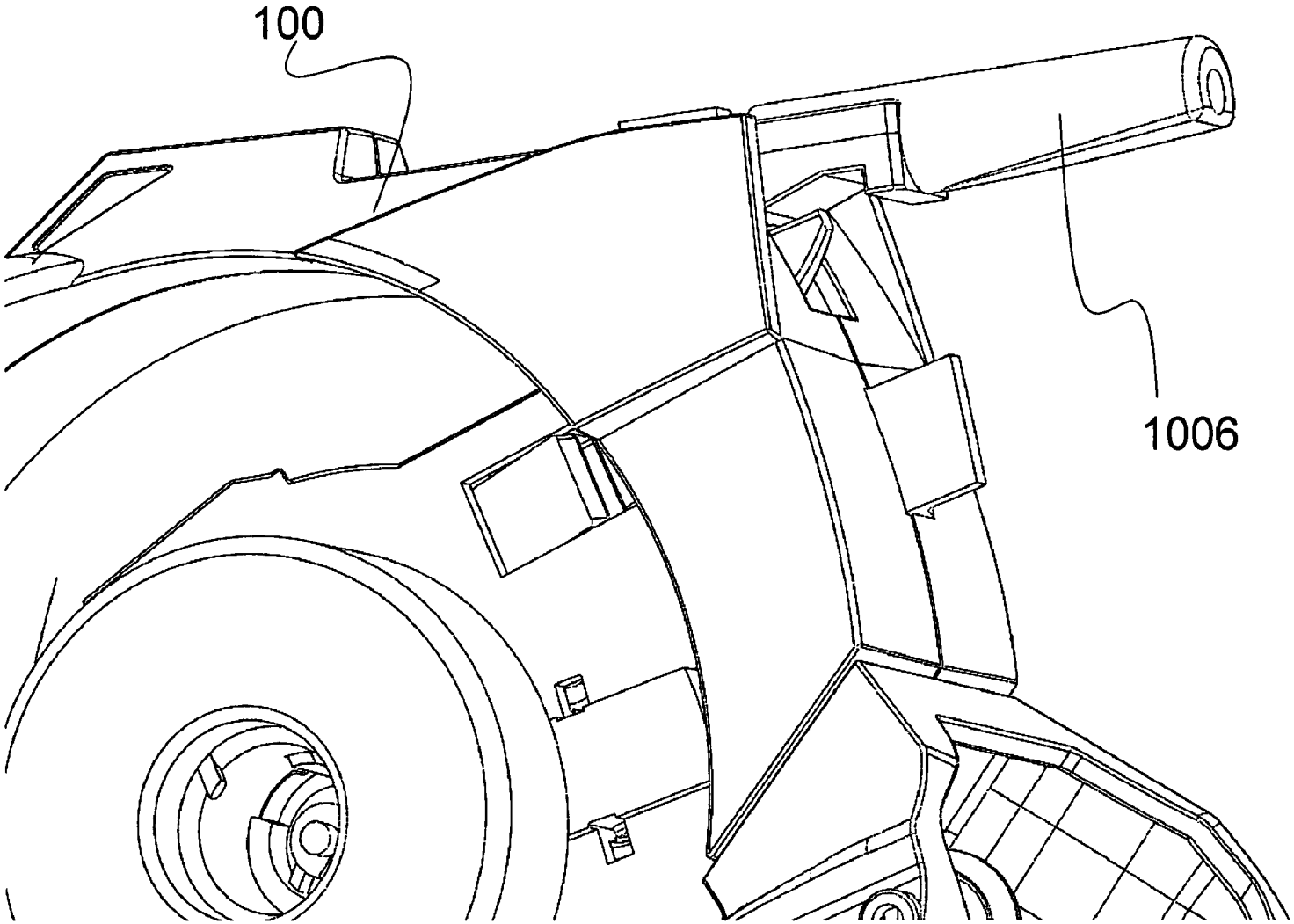
FIG. 16 is a close-up view illustration of a rear portion of the toy vehicle.

FIG. 12 illustrates a front perspective view of the toy vehicle 100 and the launcher 1000. FIG. 13 illustrates a rear perspective view of the toy vehicle 100 and the launcher. FIG. 14 illustrates the toy vehicle 100 and an interior of the launcher 1000. FIG. 15 illustrates a close-up view of the interior of the launcher 1000. FIG. 16 illustrates a close-up view of a rear portion 1012 of the toy vehicle 100.

As clearly indicated in FIGS. 12 through 16, the attachment member 1006 is formed to be inserted into the launcher 1000 and engage with the spring-loaded attachment mechanism 1002. Upon actuation of the trigger 1004, the toy vehicle is pushed away from the launcher 1000 by the spring-loaded attachment mechanism 1002, at which point the wheel engages with the ground surface to cause the toy vehicle 100 to speed away from the launcher 1000 (except in circumstances as described above regarding a non-functional trigger 1004, where the spring operates without actuation of the trigger 1004).

As briefly described above, the wheel 106 is detachably attachable with the toy vehicle 100 through the use of a quick release apparatus. As illustrated in FIG. 10, the quick release apparatus 1014 allows a user to selectively attach and detach the wheel 106. The quick release apparatus 1014 is any suitable quick release apparatus for selectively attaching and detaching a toy wheel, a non-limiting example of which include a slide switch 1002 that actuates an attachment/detachment mechanism (described in further detail below). For example, the slide switch 1002 is slid from its rest position and inwards to operate the attachment/detachment mechanism to engage/disengage the wheel 106. When not in use, the slide switch springs back into its rest position.

Figure 17:
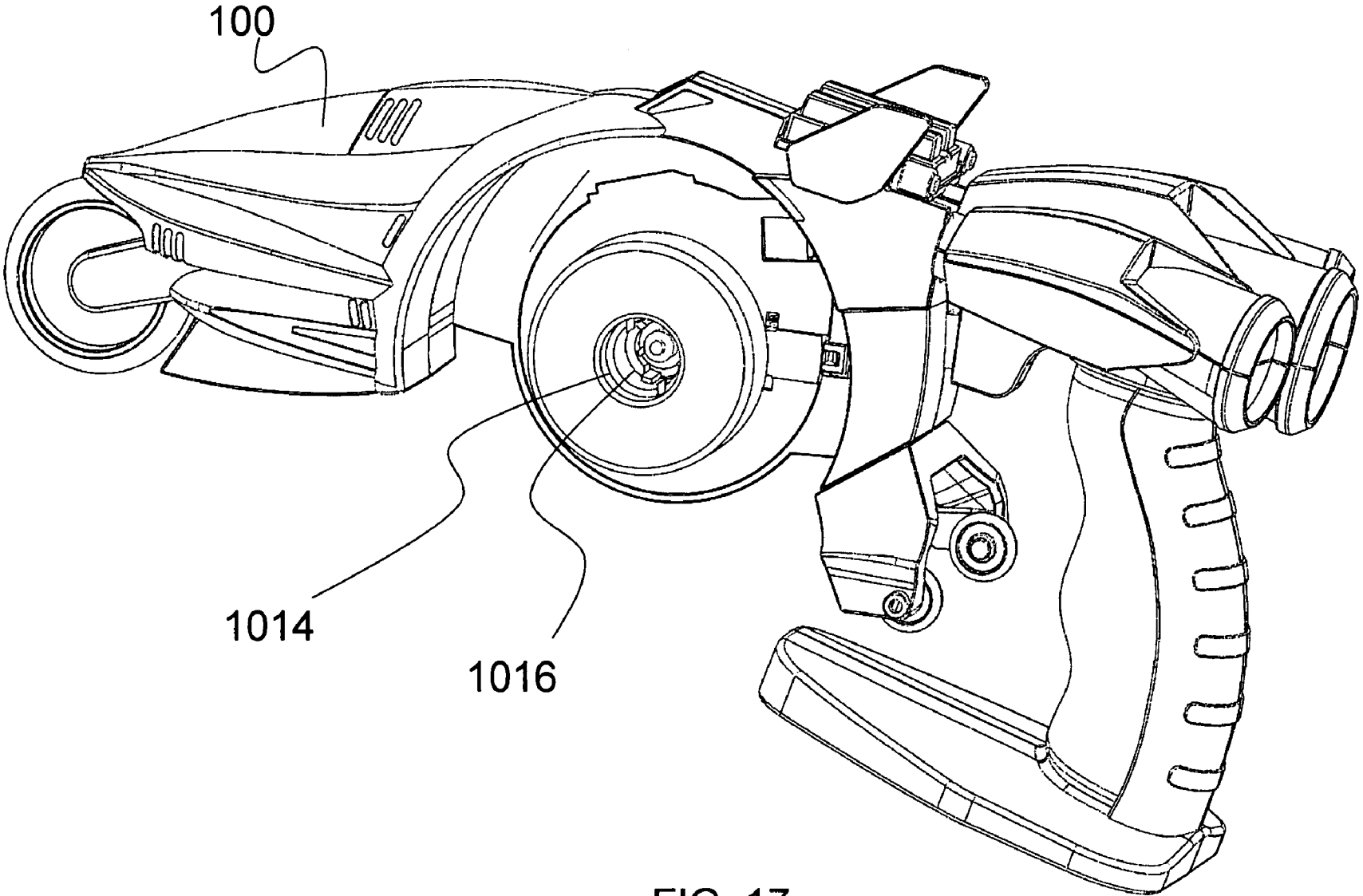
FIG. 17 is a left, perspective-view illustration of the toy vehicle and launcher according to the present invention.
Figure 18:
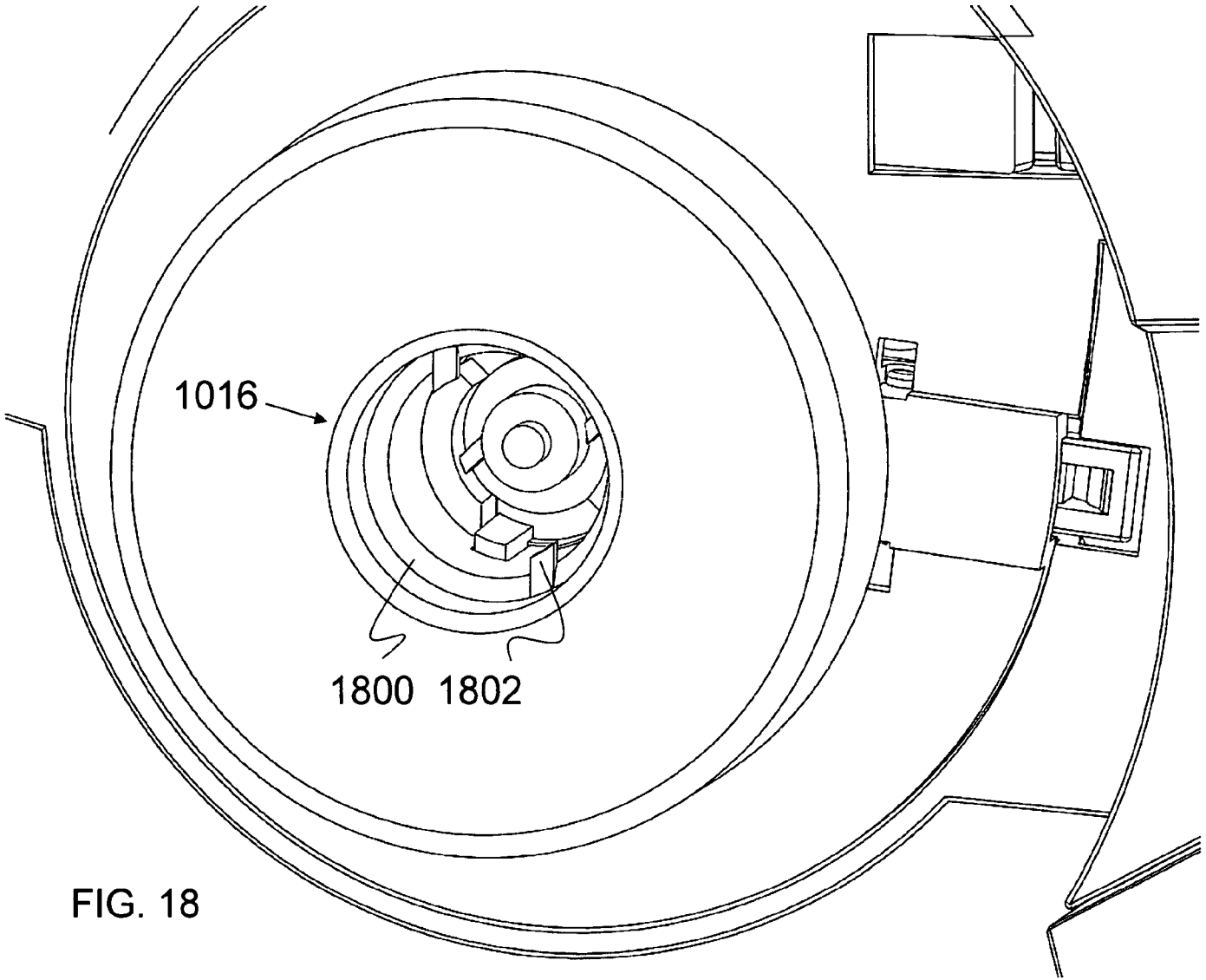
FIG. 18 is a close-up view illustration of an attachment/detachment mechanism according to the present invention.
Figure 19:
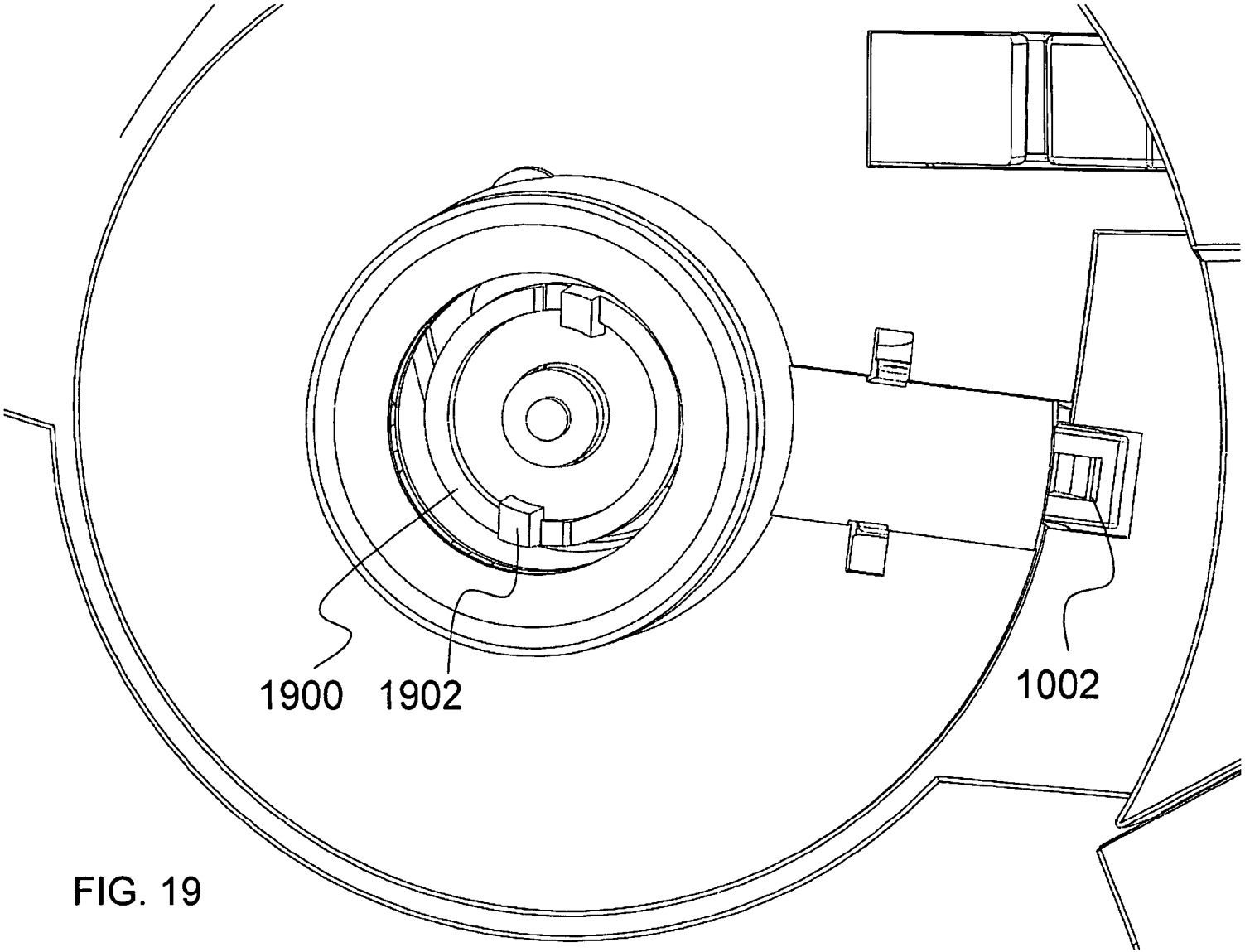
FIG. 19 is an illustration of a withdrawing member and a catch protruding from it according to the present invention.
Figure 20:
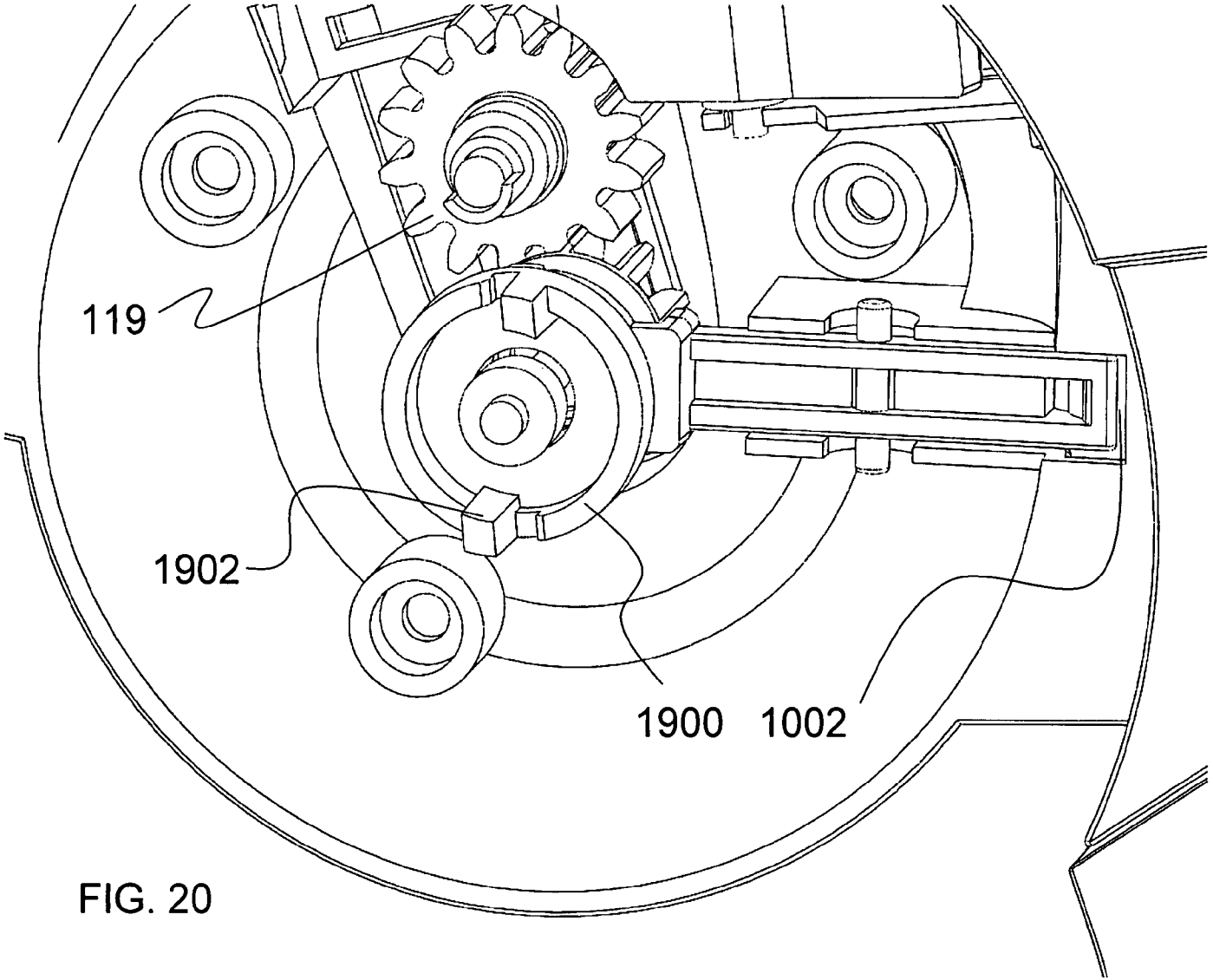
FIG. 20 is an illustration of the attachment/detachment mechanism with a drum removed.

FIG. 17 illustrates another view of the toy vehicle 100, showing the wheel removed and another portion of the quick release apparatus 1014. As referenced above, the quick release apparatus 1014 also includes an attachment/detachment mechanism 1016. As can be appreciated by one skilled in the art, there are numerous techniques for forming a quick release apparatus and attachment/detachment mechanism, and as such, the specific example described herein is for illustrative purposes only and is not intended to be limited thereto. FIG. 18 illustrates a close-up view of the attachment/detachment mechanism 1016. The attachment/detachment mechanism 1016 further includes a drum 1800 with a tab 1802 therein. As shown in FIG. 19, a withdrawing member 1900 with a catch 1902 protruding from it is connected with the slide switch 1002. FIG. 20 illustrates the attachment/detachment mechanism 1016 with the drum removed. As clearly shown in FIG. 20, the slide switch 1002 is connected with the withdrawing member 1900. Also shown in FIG. 20 is the gear system 119 for driving an attached detachably attachable wheel.

As will become apparent below, the tab 1802 slides within a notch on a receiving element of the wheel, with the catch 1902 affixing the wheel to the quick release apparatus 1014. Using the slide switch 1002 to withdraw the withdrawing member 1900 and its catch 1902 allows the wheel to disengage from the toy vehicle.

Figure 21:
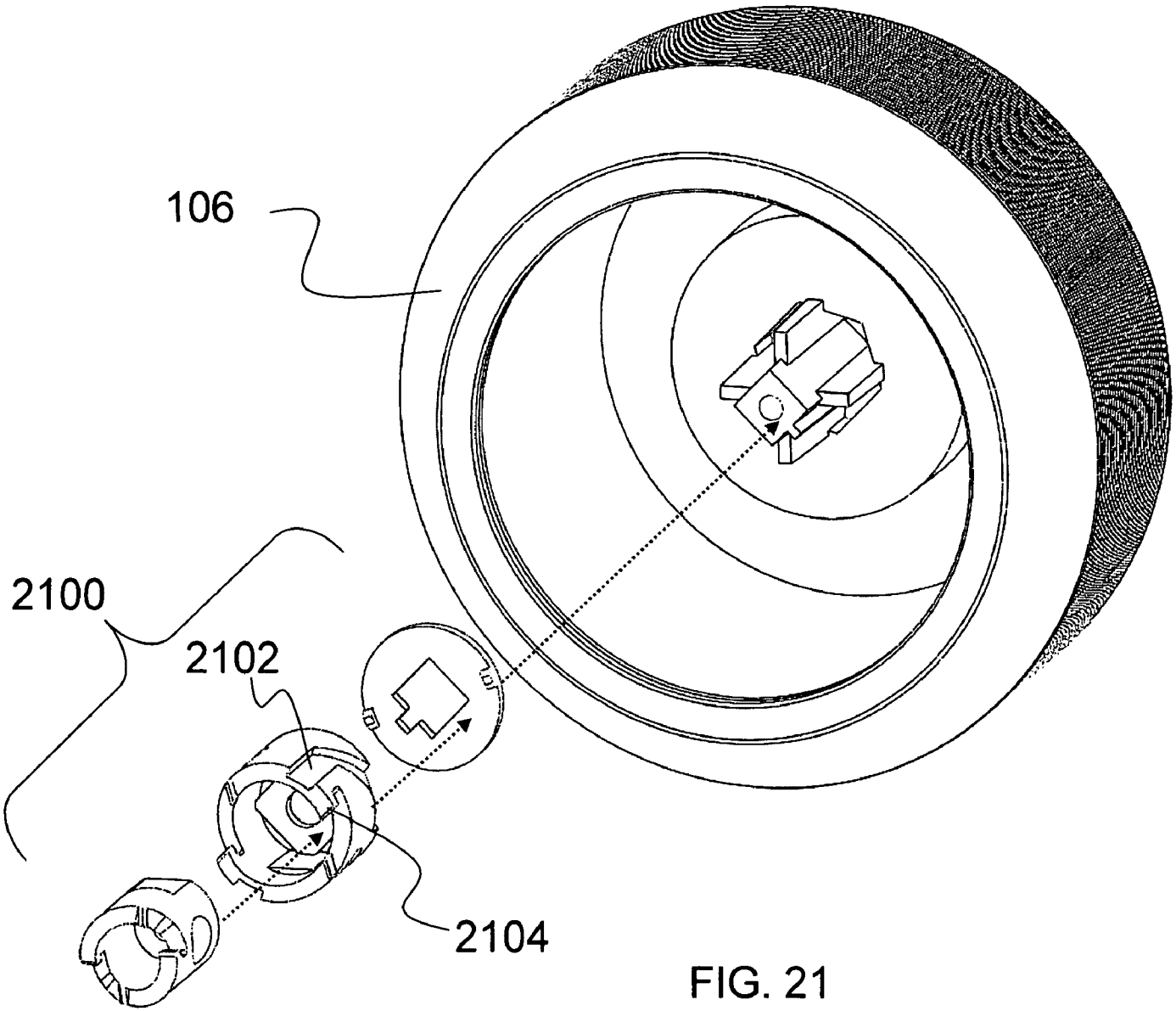
FIG. 21 is a exploded-view illustration of a detachably attachable wheel according to the present invention.

FIG. 21 is an exploded view illustration of the detachably attachable wheel 106 and its receiving element 2100. The receiving element 2100 is formed in any suitable manner to be connected with the quick release apparatus. As a non-limiting example, the receiving element includes a notch 2102 and a driving edge 2104 formed therein.

As depicted in FIGS. 17 through 10, the wheel 106 is detachably attachable with a quick release apparatus 1014. In attaching a wheel 106, the receiving element 2100 is slid into the drum 1800 such that the tab 1802 slides within the notch 2102. After sliding into place, the catch 1902 is engaged with the driving edge 2104 to affix the wheel 106 with the quick release apparatus 1014. When attached with a wheel 106, the quick release apparatus 1014 operates as a driving element to drive the wheel 106.

To remove the wheel 106, the slide switch 1002 is used to withdraw the withdrawing member 1900. Upon withdrawal, the catch 1902 is withdrawn from the driving edge 2104, thereby allowing the tab 1802 to be slid out of the notch 2102, resulting in the removal of the wheel 106.

In addition to changing the wheels for aesthetic purposes, different interchangeable wheels provided a variety of functional differences. For example, wheels with varying diameters provide for varying speeds. As such, it may be desirable to change the wheel with another interchangeable wheel to increase or decrease the toy vehicle 100. Because of this need and desire to change the wheels 106, the wheels 106 are formed to be interchangeable with other detachably attachable wheels. As such, the wheels 108 may be formed in a variety of shapes and sizes, so long as they are detachably attachable with the toy vehicle 100.

(2.2) Toy for Rotating and Launching a Toy Wheel

Figure 22A:
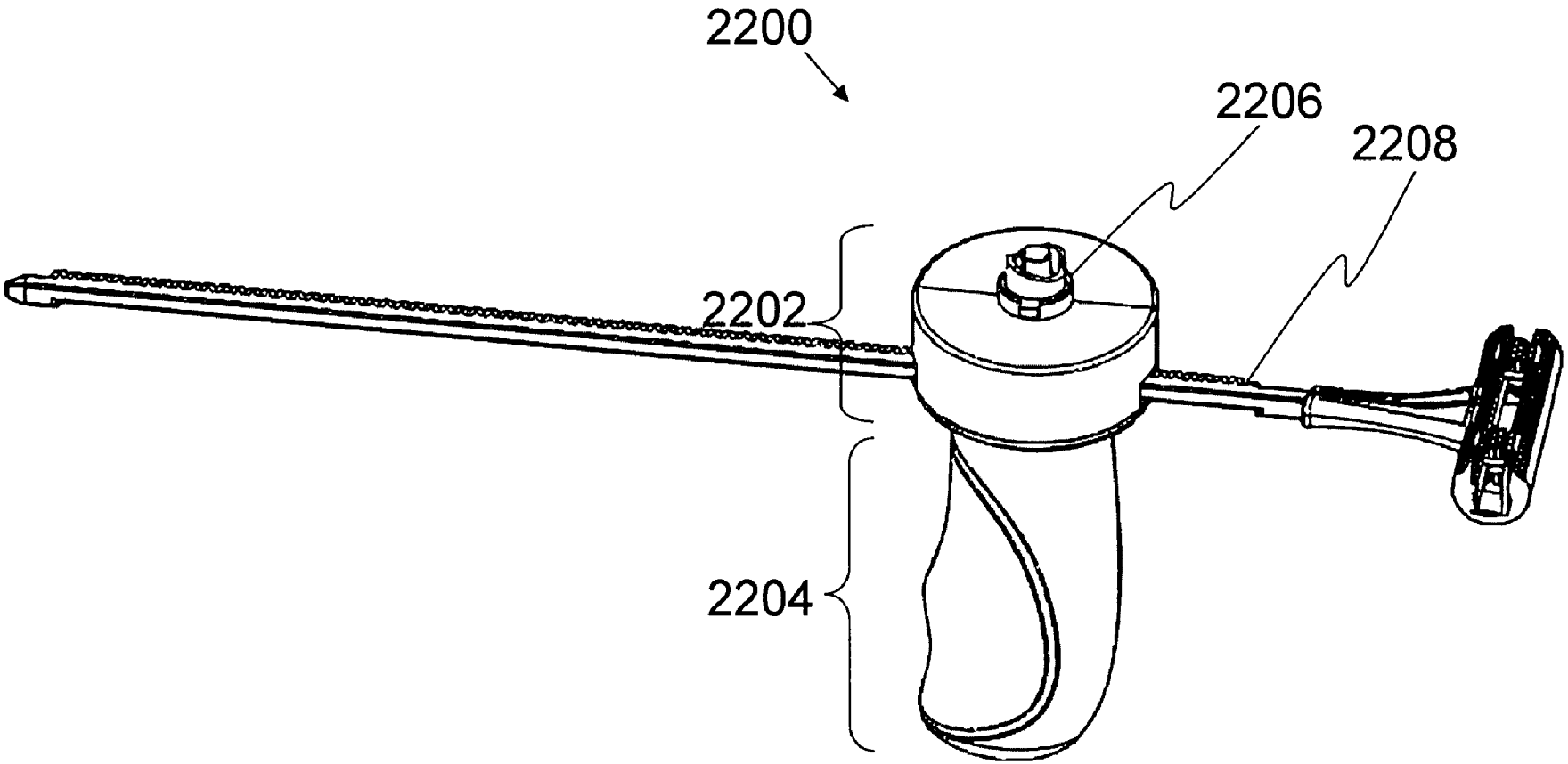
FIG. 22A is an illustration of a toy for rotating and launching an object according to the present invention.
Figure 22B:
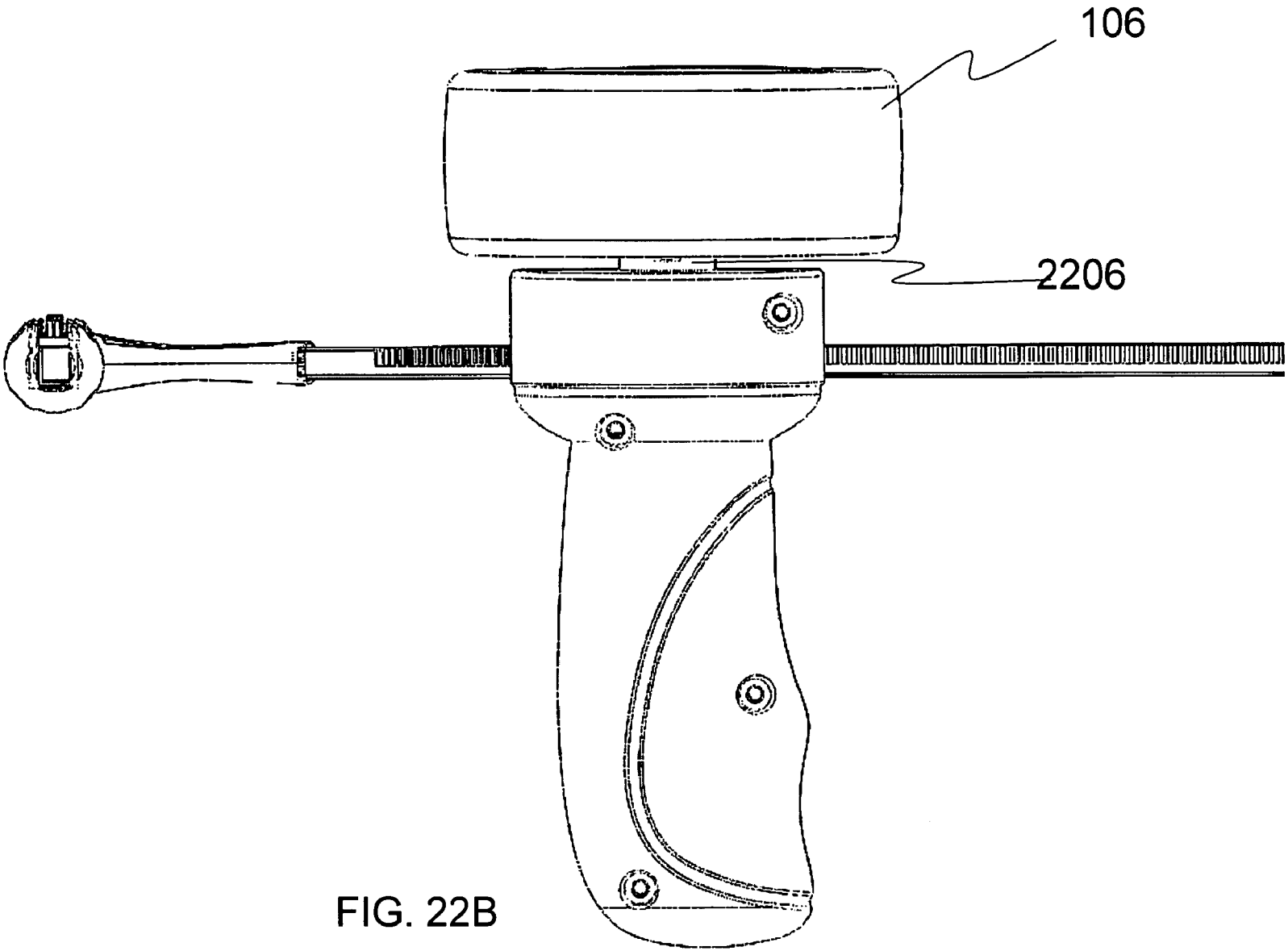
FIG. 22B is an illustration of the toy for rotating and launching an object according to the present invention, with the object attached with the toy.

As described above, the wheels 106 are formed to be used with a variety of devices. By way of example, the wheels are formed to be used with a toy for rotating and launching the wheels. In one aspect, as illustrated in FIG. 22A, the toy 2200 comprises a housing 2202, a handle 2204, a launcher 2206, and a launcher rotating system (not illustrated) including a gear rack 2208. The launcher rotating system is located inside the housing 2202, and the launcher rotating system is drivingly connected with the gear rack 2208 such that when the gear rack 228 is moved, the launcher rotating system translates the movement of the gear rack 2208 into a rotary motion. The launcher rotating system is then drivingly connected with the launcher 2206. When an object such as a wheel 106 is connected with the launcher 2206, as in FIG. 22B, the launcher 1006 rotationally accelerates the wheel 106 until the wheel 106 is released from the launcher 2206 and propelled forward.

Although a gear rack 2208 is shown in the aspect of FIG. 22A, one skilled in the art will appreciate that the launcher rotating system can comprise a motor or other manually operated mechanism to cause the rotation of the launcher 2206.

It should be noted that the gear system 119 described herein references a specific gear configuration for illustrative purposes only, and that it is not intended to be limited thereto. As can be appreciated by one in the art, there are many gear system configurations that can be utilized to cause the detachably attachable wheel to spin away from the launcher.

What is claimed is:

1. A toy vehicle comprising:

a vehicle housing having a wheel opening in the housing for placement of a detachably attachable wheel and a vehicle strip opening for placement of a strip;

a gear system attached with the housing, the gear system having gear teeth for engaging at least a part of the gear system with the strip;

a rotating end connected with the gear system and being accessible via the wheel opening for placement of a detachably attachable wheel, the rotating end being configured to be detachably attached with the detachably attachable wheel, whereby when a detachably attachable wheel is placed within the wheel opening and affixed with the rotating end, and when the strip is inserted into the vehicle strip opening and engaged with the gear teeth, a user may pull the strip from the housing and thereby cause the gear system to rotate the rotating end and the detachably attachable wheel so that the detachably attachable wheel spins and forces the vehicle to speed away from the user;

a detachably attachable wheel for placement within the wheel opening, the wheel having a central rotor for engaging with the rotating end, wherein each detachably attachable wheel further comprises a receiving element, the receiving element including a notch and driving edge formed therein;

a strip having teeth, the strip being adapted to be inserted into the strip opening and engage with the gear teeth;

a launcher for connecting with and launching the toy vehicle;

a quick release apparatus for attaching with and locking the detachably attachable wheel to the toy vehicle, wherein the quick release apparatus comprises:

a slide switch attached with the vehicle housing;

a drum having tabs attached with the vehicle housing;

a withdrawing member attached with the vehicle housing and operably connected with the slide switch, the withdrawing member having a catch for engaging with a driving edge of the receiving element, whereby a detachably attachable wheel may be attached with the quick release apparatus by sliding the receiving element into the drum such that the tab slides within the notch, the catch thereafter engaged with the driving edge, and when detaching the detachably attachable wheel, the slide switch is used to withdraw the withdrawing member such that the catch is withdrawn from the driving edge, thereby allowing the tab to be slid out of the notch which results in the removal of the detachably attachable wheel.

2. A toy vehicle as set forth in claim 1, wherein the launcher is formed to hold the detachably attachable wheel off of a ground surface when the toy vehicle is attached with the launcher.

3. A toy vehicle as set forth in claim 2, wherein the housing has a front portion and a rear portion, and where the wheel opening is formed at the rear portion for placement of the detachably attachable wheel therein.

4. A toy vehicle as set forth in claim 3, further comprising a flywheel attached with the gear system, the flywheel having weight such that as the strip is pulled from the gear system to rotate the rotating end to have a rotational momentum, the weight of the flywheel increases the rotational momentum.

5. A toy vehicle as set forth in claim 4, wherein the detachably attachable wheel is formed to be used with a device other than the toy vehicle.

6. A toy vehicle as set forth in claim 5, wherein the device other than the toy vehicle is a hand launcher for launching the detachably attachable wheel.

7. A toy vehicle as set forth in claim 6, wherein the launcher further comprises a spring-loaded attachment mechanism and a trigger operably connected with the spring-loaded attachment mechanism, and wherein the toy vehicle further comprises an attachment member for attaching with the spring-loaded attachment mechanism, whereby a user may attach the toy vehicle with the launcher -and use the strip to rotatably accelerate the detachably attachable wheel, and upon squeezing the trigger the toy vehicle is launched from the launcher after which the detachably attachable wheel engages with a ground surface to cause the toy vehicle to speed away from the launcher.

8. A toy vehicle as set forth in claim 6, wherein the launcher further comprises a spring and wherein the toy vehicle further comprises an attachment member for engaging with the spring loaded attachment mechanism, whereby when the attachment member is engaged with the spring, use of the strip pulls the toy vehicle towards the handle, thereby compressing the spring, such that when the strip is pulled out of the toy vehicle, the spring expands to force the toy vehicle away from the handle, thereby helping to overcome the initial inertia of the toy vehicle so it will roll farther.

9. A toy vehicle comprising:

a vehicle housing having a wheel opening in the housing for placement of a detachably attachable wheel and a vehicle strip opening for placement of a strip;

a gear system attached with the housing, the gear system having gear teeth for engaging at least a part of the gear system with the strip;

a rotating end connected with the gear system and being accessible via the wheel opening for placement of a detachably attachable wheel, the rotating end being configured to be detachably attached with the detachably attachable wheel, whereby when a detachably attachable wheel is placed within the wheel opening and affixed with the rotating end, and when the strip is inserted into the vehicle strip opening and engaged with the gear teeth, a user may pull the strip from the housing and thereby cause the gear system to rotate the rotating end and the detachably attachable wheel so that the detachably attachable wheel spins and forces the vehicle to speed away from the user;

a detachably attachable wheel for placement within the wheel opening, the wheel having a central rotor for engaging with the rotating end, each detachably attachable wheel further comprises a receivmnn element, the receiving element including a notch and driving edge formed therein;

a quick release apparatus for attaching with and locking the detachably attachable wheel to the toy vehicle, wherein the quick release apparatus comprises:

a slide switch attached with the vehicle housing;

a drum having tabs attached with the vehicle housing;

a withdrawing member attached with the vehicle housing and operably connected with the slide switch, the withdrawing member having a catch for engaging with a driving edge of the receiving element, whereby a detachably attachable wheel may be attached with the quick release apparatus by sliding the receiving element into the drum such that the tab slides within the notch, the catch thereafter engaged with the driving edge, and when detaching the detachably attachable wheel, the slide switch is used to withdraw the withdrawing member such that the catch is withdrawn from the driving edge, thereby allowing the tab to be slid out of the notch which results in the removal of the detachably attachable wheel.

* * * * *